US005901920A

United States Patent [19]

Takahashi et al.

[11] Patent Number: 5,901,920

[45] Date of Patent: May 11, 1999

[54] CORD TAKE-UP REEL, APPARATUS FOR AUTOMATICALLY TAKING UP THE CORD USING SAID REEL, AND DEVICE FOR AUTOMATICALLY FASTENING CORD END

[75] Inventors: Masashi Takahashi; Masanori Kumagai; Tasuku Kikuchi, all of Kitakami, Japan

[73] Assignee: Tokyo Rope Mfg. Co., Ltd., Tokyo, Japan

[21] Appl. No.: 08/925,612

[22] Filed: Sep. 8, 1997

Related U.S. Application Data

[63] Continuation-in-part of application No. 08/658,271, Jun. 5, 1996, abandoned.

[30] Foreign Application Priority Data

| | | | |
|---|---|---|---|
| Jun. 5, 1995 | [JP] | Japan | 7-160116 |
| Dec. 21, 1995 | [JP] | Japan | 7-349007 |
| May 27, 1996 | [JP] | Japan | 8-152931 |
| Mar. 7, 1997 | [JP] | Japan | 9-068975 |

[51] Int. Cl.[6] ..... B65H 19/29

[52] U.S. Cl. ..... 242/580; 242/125.2; 242/125.3

[58] Field of Search ..... 242/580, 125.2, 242/125.3

[56] References Cited

U.S. PATENT DOCUMENTS

| | | | |
|---|---|---|---|
| 472,593 | 4/1892 | Tache . | |
| 1,095,723 | 5/1914 | Frisoli . | |
| 1,408,261 | 2/1922 | Brookhart . | |
| 1,455,167 | 5/1923 | Joslin . | |
| 1,679,573 | 8/1928 | Hind . | |
| 2,302,965 | 11/1942 | Lucia . | |
| 4,715,557 | 12/1987 | Rushing et al. | 242/129 |
| 5,485,968 | 1/1996 | Fujioka | 242/125.2 |
| 5,549,257 | 8/1996 | Sanda et al. | 242/580 |
| 5,586,733 | 12/1996 | Miura et al. | 242/125.2 |
| 5,603,469 | 2/1997 | Stocchi | 242/580 |

FOREIGN PATENT DOCUMENTS

| | | |
|---|---|---|
| 0 520 256 | 12/1992 | European Pat. Off. . |
| 6-127842 | 4/1994 | Japan . |

*Primary Examiner*—Donald P. Walsh
*Assistant Examiner*—William A. Rivera
*Attorney, Agent, or Firm*—Morrison & Foerster

[57] ABSTRACT

The operation for fastening the end portion of a cord-like body is facilitated, the operation is capable of being automated and the end of the cord-like body is capable of being secured in reliable fashion. A window for receiving a resilient cord retainer is formed near the outer circumference of at least one flange of flanges provided on both ends of a winding drum. The cord retainer comprises a central retaining finger, a pair of fixing fingers, one provided on either side of the central retaining finger, and a connecting piece interconnecting the retaining finger and fixing fingers. Distal ends of the fixing fingers and the connecting piece are abutted against upper and lower edges, respectively, of the window from outside the flange, and the distal end portions of the fixing fingers are crimped and secured by a folded-back portion on the outer circumference of the flange. The distal end portion of the central retaining finger lies on the inner side surface of the flange on the outer circumferential portion thereof, and the cord-like body is clamped and secured between the distal end portion of the retaining finger and the inner side surface of the flange at the outer circumferential portion thereof.

30 Claims, 43 Drawing Sheets

CORD TAKE-UP REEL, APPARATUS FOR AUTOMATICALLY TAKING UP THE CORD USING SAID REEL, AND DEVICE FOR AUTOMATICALLY FASTENING CORD END

This application is a continuation-in-part of Ser. No. 08/658,271 filed Jun. 5, 1996, abandoned.

BACKGROUND OF THE INVENTION

1. Field of the Invention

This invention relates to a reel for taking up cords and cord-like bodies, a wire clip used upon being attached to this reel, an apparatus, suited for use with this reel, for automatically taking up the cord-like body, and a device for fastening the end of the cord-like body.

The term "cord-like body" (or "cord") as used here is meant to cover all linear bodies (inclusive of standed wire), regardless of the material, referred to by various names such as steel cord, filament, metal wire, wire, rope, wire cable, synthetic resin line, steel and string.

2. Description of the Related Art

After a cord-like body, especially a strongly resilient cord-like body made of steel, is taken up on a reel, it is required that one end thereof be fastened to the reel at a suitable location. One structure for fastening the end of a cord-like body is described in the specification of Japanese Utility Model Application laid-Open No. 3-62069.

According to the structure disclosed, the outer circumferential portion of a reel flange is formed to have a slot from which the end of a cord is capable of being pulled, and the outside surface of the flange is provided with a fastening member, such as a clip or spring, at a position adjacent the slot. The cord end portion (a portion somewhat short of the end of the cord) is plastically deformed into a U- or C-shaped configuration, this portion is passed through the slot and is pulled out of the flange, and the curved portion that has been pulled out is fastened by being clipped.

With a structure of this type, the end portion of the cord must be pulled out through the slot, and fastening the cord end is a troublesome task. This structure does not lend itself to automation. Further, since the cord is bent or curved into a U- or V-shaped configuration, a fairly long portion of the cord is wasted.

Since a reel suited to automation of end fastening does not exist, it has not been possible, as a matter of course, to realize a device capable of automatically fastening the end of a cord and an apparatus which takes up the cord and includes the above-mentioned device.

SUMMARY OF THE INVENTION

An object of the present invention is to provide a reel for taking up a cord-like body, wherein the end of the cord-like body can be secured through a simple fastening operation and in reliable fashion.

Another object of the present invention is to provide a reel for taking up a cord-like body, wherein fastening the end of the cord-like body can be automated.

Yet another object of the present invention is to provide the structure of a reel for taking up a cord-like body, wherein the structure makes it possible to minimize the amount of a cord end that is wasted.

A further object of the present invention is to provide the structure of a reel for taking up a cord-like body, wherein the structure makes it possible to retain the cord end in such a manner that the cord end will not spring out from the reel.

A further object of the present invention is to provide a device for automatically fastening the end of a cord-like body using the reel described above.

A further object of the present invention is to provide an apparatus for automatically taking up a cord-like body, the apparatus including the end fastening device described above.

A reel for taking up a cord-like body according to a first aspect of the present invention comprises a winding drum; flanges provided on both ends of the winding drum, at least one of the flanges being provided with a window at a location in the vicinity of an outer circumferential portion thereof; and a cord retainer comprising a resilient body, the cord retainer being received within the window and including a central retaining finger having a distal end portion; a pair of fixing fingers, one provided on either side of the central retaining finger and each having a distal end portion; and a connecting piece interconnecting the retaining finger and the fixing fingers; the distal ends of the fixing fingers and the connecting piece being abutted against upper and lower edges, respectively, of the window from outside the at least one flange, the distal end potions of the fixing fingers being crimped and secured by a folded-back portion on the outer circumference of the at least one flange, and the distal end portion of the central retaining finger lying on an inner side surface of the at least one flange on the outer circumferential portion thereof; the cord-like body being clamped and secured between the distal end portion of the retaining finger and the inner side surface of the at least one flange at the outer circumferential portion thereof.

A reel for taking up a cord-like body according to a second aspect of the present invention comprises a winding drum; flanges provided on both ends of the winding drum, at least one of the flanges being provided with a window at a location in the vicinity of an outer circumferential portion thereof; and a cord retainer comprising a resilient body, the cord retainer being attached within the window and including a central retaining finger having a distal end portion; a pair of fixing fingers, one provided on either side of the central retaining finger and each having a distal end portion; and a connecting piece interconnecting the retaining finger and the fixing fingers; the fixing fingers and the connecting piece lying on an outer surface of the at least one flange at the left, right and lower sides of the window, the distal end portions of the fixing fingers being crimped and secured by a folded-back portion on the outer circumference of the at least one flange, the central retaining finger being curved at a central portion thereof so as to project outwardly of the at least one flange from the window with the distal end portion thereof being passed through the window so as to lie on an inner side surface of the at least one flange on the outer circumferential portion thereof; the cord-like body being clamped and secured between the distal end portion of the retaining finger and the inner side surface of the at least one flange at the outer circumferential portion thereof.

The cord take-up reel according to the first aspect of the invention and the cord take-up reel according to the second aspect of the invention may be summarized as follows: The cord take-up reel has a winding drum both ends of which are provided with flanges, and a window for receiving a cord retainer, which is formed near the outer circumferential of at least one flange of the flanges. The cord retainer, which comprises a resilient body, comprises a central retaining finger, a pair of fixing fingers, one provided on either side of the central retaining finger, and a connecting piece interconnecting the retaining finger and fixing fingers. Distal ends of the fixing fingers are crimped and secured by a folded-back portion on the outer circumference of the flange. The distal end portion of the central retaining finger lies on the inner side surface of the flange on the outer circumferential portion thereof, and the cord-like body is clamped and secured between the distal end portion of the retaining finger and the inner side surface of the flange at the outer circumferential potion thereof.

In accordance with the cord take-up reel of the present invention, the central retaining finger of the cord retainer is pushed from the outside by the finger of the worker or by part of a machine after the cord is taken up on the reel, thereby forming a gap between the distal end portion of the retaining finger and the inner side surface of the flange at its outer circumferential portion. If the end portion of the cord is inserted into the gap, then the end portion will be clamped between the distal end portion of the retaining finger and the inner side surface of the flange at its outer circumferential portion. Accordingly, the operation for fastening the cord end is a simple one. Further, since the cord retainer is formed from a resilient body, the end portion of the cord is secured reliably by the elastic force thereof. In the cord take-up reel according to the second aspect of the invention, the central retaining finger of the cord retainer is curved outwardly so as to project outwardly from the flange. This makes it easier for this portion to be pushed.

The central retaining finger of the cord retainer is capable of being pushed by a push rod (pusher) of a machine or by some other mechanical member. As a result, not only the winding of the cord on the reel but also the fastening of the cord end can be performed automatically by machine. A device for fastening the cord end will be described later.

The distal end portion of the central retaining finger of the cord retainer lies on the inner side surface of the outer circumferential portion of the flange, and the end of the cord is secured by this portion. As a result, there is no danger that the end of the cord will fly off the reel.

If the end of a cord that has been taken up on the reel has even a little length, the cord end can be led to the position of the cord retainer. This means that the length of cord wasted in order to fasten its end can be minimized, thereby improving economy.

The cord retainer can be attached to the flange merely by crimping and fixing the distal ends of the fixing fingers by the folded-back portion along the outer circumference of the flange. As a result, assembly is simple and the reel can be provided at low cost.

The connecting piece of the cord retainer merely abuts against the lower edge of the window from the outer side of the flange. If the connecting piece were fixed, e.g., by welding, stress would concentrate in the vicinity of the fixed portion and the cord retainer would tend to break off. According to the present invention, however, the connecting piece is not fixed. As a result, stress produced when the end of the cord is retained is dispersed, thereby prolonging the life of the cord retainer. In addition, the resilience needed to retain the cord end is enhanced.

In an embodiment of the invention, a recess for receiving the distal end portion of the retaining finger is formed on the inner side surface of the flange on the outer circumferential portion thereof along which the distal end portion of the retaining finger lies. Since the retaining finger of the cord retainer can be received in the recess, the retaining finger is not an obstacle when the cord is taken up on the reel.

In another embodiment, a recess for receiving at least part of the cord-like body is formed in the distal end portion of the retaining finger. Since the recess is formed in the retaining finger of the cord retainer, the end portion of the cord fits into the recess, whereby the cord end is reliably secured and will not become dislodged. Since the retaining finger does not curve inwardly that much, an excessive force is not applied to the base portion of the finger even when the end of the cord is in the clamped state. This makes it less likely that the retaining finger will break off in the vicinity of its base.

The portion retained by the retaining finger of the cord retainer is not the end of the cord but is a location somewhat short of the end of the cord. Thus, the end of the cord is capable of moving freely.

Accordingly, it is preferred that the outer circumferential portion of the flange be formed to have a cord-end retaining portion at a position offset a suitable distance from the cord retainer in the cord take-up direction along the outer circumference of the flange.

The end retaining portion makes it possible to reliably secure the end of the cord as well. As a result, it is possible to prevent accidents in which the end of the cord flies off the reel (in which case the end of the cord may injure the eye of a worker or contact and damage other reels during transport).

The cord retainer may be provided on both of the left and right flanges of the reel. The same holds true for the cord-end retaining portion. In such case it is preferred that the position relationship between the cord retainers and between the cord-end retaining portions be decided in such a manner that after the cord has been wound upon the reel in one direction, the end of the cord can be retained on either the left or right flange.

It is preferred that the cord retainer be a resilient body that is as hard as possible. It is especially preferred that the cord retainer be formed from carbon tool steel. The Rockwell hardness HRc thereof should be no less than 27, and preferably no less than 30. The cord retainer can be hardened further by being subjected to heat treatment (quenching followed by annealing).

A reel for taking up a cord-like body according to a third aspect of the present invention comprises a winding drum; flanges provided on both ends of the winding drum; a cord retainer comprising a resilient body, the cord retainer being attached to at least one of the flanges, and including: a central retaining finger having a distal end portion; attaching fingers provided on both sides of the central retaining finger; and a connecting piece interconnecting the retaining finger and the attaching fingers; the at least one flange being provided with a window at a location in the vicinity of an outer circumferential portion thereof and first engaging members formed on both sides of the window; each of the attaching fingers of the cord retainer being provided with a second engaging member formed thereon engaging with the first engaging member; the distal end portion of the retaining finger being brought inside the flange through the window and resiliently urged to an inner surface of the flange; and at least the attaching fingers and the connecting piece being urged to the flange from outside the flange.

In accordance with the cord take-up reel of the present invention, the central retaining finger of the cord retainer is pushed from the outside by the finger of the worker or by part of a machine after the cord is taken up on the reel, thereby forming a gap between the distal end portion of the retaining finger and the inner side surface of the flange at its outer circumferential portion. If the end portion of the cord is inserted into the gap, then the end portion will be clamped between the distal end portion of the retaining finger and the inner side surface of the flange at its outer circumferential portion. Accordingly, the operation for fastening the cord end is a simple one. Further, since the cord retainer is formed from a resilient body, the end portion of the cord is secured reliably by the elastic force thereof.

In the reel defined according to the third aspect of the present invention, as in the reel defined in accordance with the first and second aspects of the present invention, such technical advances can be led that the central retaining finger of the cord retainer is capable of being pushed by a push rod (pusher) of a machine or by some other mechanical member, the fastening of the cord end can be performed automatically by machine, there is no danger that the end of cord will fly off the reel, the length of cord wasted in order to fasten its end can be minimized, thereby improving economy and so on.

The cord retainer is positioned by engagement of the first and second engaging members, and is secured to the flange by the distal end portion of the retaining finger elastically urging the flange from inside thereof and the attaching fingers and the connecting piece elastically urging the flange from outside. Accordingly, assembling is simple. Further since the cord retainer can be exchanged when necessary, the reel itself can be used for a long time.

The connecting piece of the cord retainer merely abuts against the lower edge of the window from the outer side of the flange. If the connecting piece were fixed, e.g., by welding, stress would concentrate in the vicinity of the fixed portion and the cord retainer would tend to break off. According to the present invention, however, the connecting piece is not fixed. As a result, stress produced when the end of the cord is retained is dispersed, thereby prolonging the life of the cord retainer. In addition, the resilience needed to retain the cord end is enhanced.

In an embodiment of the invention, the attaching fingers are formed to have third engaging members at distal end portions thereof. The third engaging members are caught inside of a folded-back portion along the outer circumferential portion of the flange. As a result, the cord retainer is secured more strongly.

In another embodiment, a recess for receiving the distal end portion of the retaining finger is formed on the inner side surface of the flange on the outer circumferential portion thereof which the distal end portion of the retaining finger is made contact with. Since the retaining finger of the cord retainer is received in the recess, the retaining finger does not interfere with the operation through which the cord is taken up on the reel.

The first engaging member is, for example, a projection protruding outside the flange. Examples of the second engaging member are a hole, a cut-out, a recess and the like.

In the preferred embodiment, the distal end potion of the retaining finger is formed with a projection or a rib for preventing the end of the cord-like body from being slipped off.

A reinforcing rib is formed on a part or entirety of the retaining finger, or on a part or entirety of the attaching fingers, if necessary.

The cord retainer may be made of a metal plate or a piece of metal wire.

The outer circumferential portion of the flange is formed to have a cord-end retaining portion at a position spaced away from the cord retainer along the outer circumference of the flange in a direction in which the cord-like body is taken up. The cord-end retaining portion is located at a position which approaches an inner side of the reel from the outermost circumferential edge of the flange. Accordingly, the tip of the cord-like body does not protrude outside the reel. Even when the reel rolls on a floor, the tip of the cord-like body does not beat and contact with the floor, or such inconvenience hardly occurs. The same is true for the reel defined from the first and second aspects.

The cord take-up reel according to the first aspect of the invention, the cord take-up reel according to the second aspect of the invention and the cord take-up reel according to the third aspect of the invention may be summarized as follows: The cord take-up reel has a winding drum both ends of which are provided with flanges, and a window for receiving a cord retainer, which is formed near the outer circumference of at least one flange of the flanges. The cord retainer, which comprises a resilient body, comprises central retaining finger, a pair of fixing fingers, one provided on either side of the central retaining finger, and a connecting piece interconnecting the retaining finger and fixing fingers. Distal ends of the fixing fingers are attached to an outer surface of the flange. The distal end portion of the central retaining finger lies on the inner side surface of the flange on the outer circumferential portion thereof, and the cord-like body is clamped and secured between the distal end portion of the retaining finger and the inner side surface of the flange at the outer circumferential portion thereof.

The present invention further provides a cord retainer (a wire clip) which is used upon being attached to the cord-like body taking-up reel.

This wire clip comprises a resilient body and is attachable to at least one of flanges of a reel at a location in the vicinity of an outer circumferential portion of the flange, the reel having a winding drum and the flanges provided on both ends of the winding drum. The wire clip includes: a central retaining finger having a distal end portion; attaching fingers provided on both sides of the central retaining finger; and a connecting piece interconnecting the retaining finger and the attaching fingers; each of the attaching fingers of the cord retainer being provided with an engaging member formed thereon engaging with another engaging member provided on the flange.

This wire clip is detachably attached to the reel for taking up the cord-like body to be used for fastening the end of the cord-like body.

The present invention provides an apparatus capable of winding a cord around the above-mentioned reel and fastening the end of the cord automatically.

An apparatus for automatically taking up a cord-like body according to the present invention comprises a transfer mechanism for transferring a reel from a cord take-up position to an end fastening position; a first holding and rotating mechanism for holding and rotating a reel at the cord take-up position to take up the supplied cord-like body; a traverse roll for moving the cord-like body, which is supplied to the reel at the cord take-up position, back and forth axially of the reel; a second holding mechanism for holding the reel at the end fastening position; a pusher for pushing a retaining finger of a cord retainer, which is provided on the reel being held by the second holding mechanism, into the reel so that a distal end portion of the retaining finger is caused to separate from a flange of the reel; and cord pushing means for pushing a portion of the cord-like body, which has been wound around the reel being held by the second holding mechanism, extending in the direction of the traverse roll, whereby a portion of the cord-like body is inserted between the distal end portion of the retaining finger and the flange.

The cord is wound around the reel at the cord take-up position. The reel having the cord wound around is transferred to the end fastening position. Here the retaining finger of the cord retainer provided on the reel is pushed by the pusher and the end portion of the cord is inserted in the gap between the distal end portion of the retaining finger and the flange of the reel. Thus, after the cord is wound around the reel, the end of the cord can be secured to the reel automatically without human intervention.

In an embodiment of the invention, a cutter is provided between the cord take-up position and the end fastening position for cutting the cord-like body after the cord-like body is inserted between the distal end portion of the retaining finger and the flange.

As preparations for taking up the cord on an empty reel at the cord take-up position, the first holding and rotating mechanism clamps the leading end of the cord between itself and the flange before the cord is cut by the cutter.

The invention cord-end fastening device used in the above-described apparatus for automatically taking up the cord-like body comprises a sensor for sensing the position of a cord retainer provided on a reel; a pusher for pushing a retaining finger of the cord retainer into the reel so that a distal end portion of the retaining finger is caused to separate from a flange of the reel; a reel holding and rotating mechanism for holding the reel, around which the cord-like body has been wound, rotating the reel until the sensor senses the position of the cord retainer, and then rotating the reel until the retaining finger of the cord retainer reaches a position opposing the pusher; and means for moving the cord-like body in such a direction that a portion of the cord-like body extending from the reel to a cord-supply side will be inserted between the distal end portion of the retaining finger and the flange.

First, the position of the cord retainer in the reel is sensed by the sensor and the reel is rotated until the retaining finger of the cord retainer reaches an angular position opposing the pusher. Thus, the pusher is capable of pushing the retaining finger reliably so that the end of the cord can be fastened with greater reliability.

A cutter is provided as necessary. The cutter cuts the cord-like body on its supply side after a portion of the cord-like body is clamped between the distal end portion of the retaining finger and the flange.

In a preferred embodiment of the invention, a mechanism is provided for allowing supply of the cord-like body without causing slackness in the cord-like body when the reel is rotated by the holding and rotating mechanism.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 5*a* and 5*b* illustrate a cord retainer in enlarged form, in which FIG. 5*a* is a front view and FIG. 5*b* is a sectional view taken along line V—V of FIG. 5*a;*

FIGS. 10*a* and 10*b* illustrate a cord retainer in enlarged form, in which FIG. 10*a* is a front view and FIG. 10*b* is a sectional view taken along line X—X of FIG. 10*a;*

DESCRIPTION OF THE PREFERRED EMBODIMENTS

First Embodiment

FIGS. 1 through 8 illustrate a first embodiment of a reel for taking up a cord-like body according to the present invention.

Figure 1:
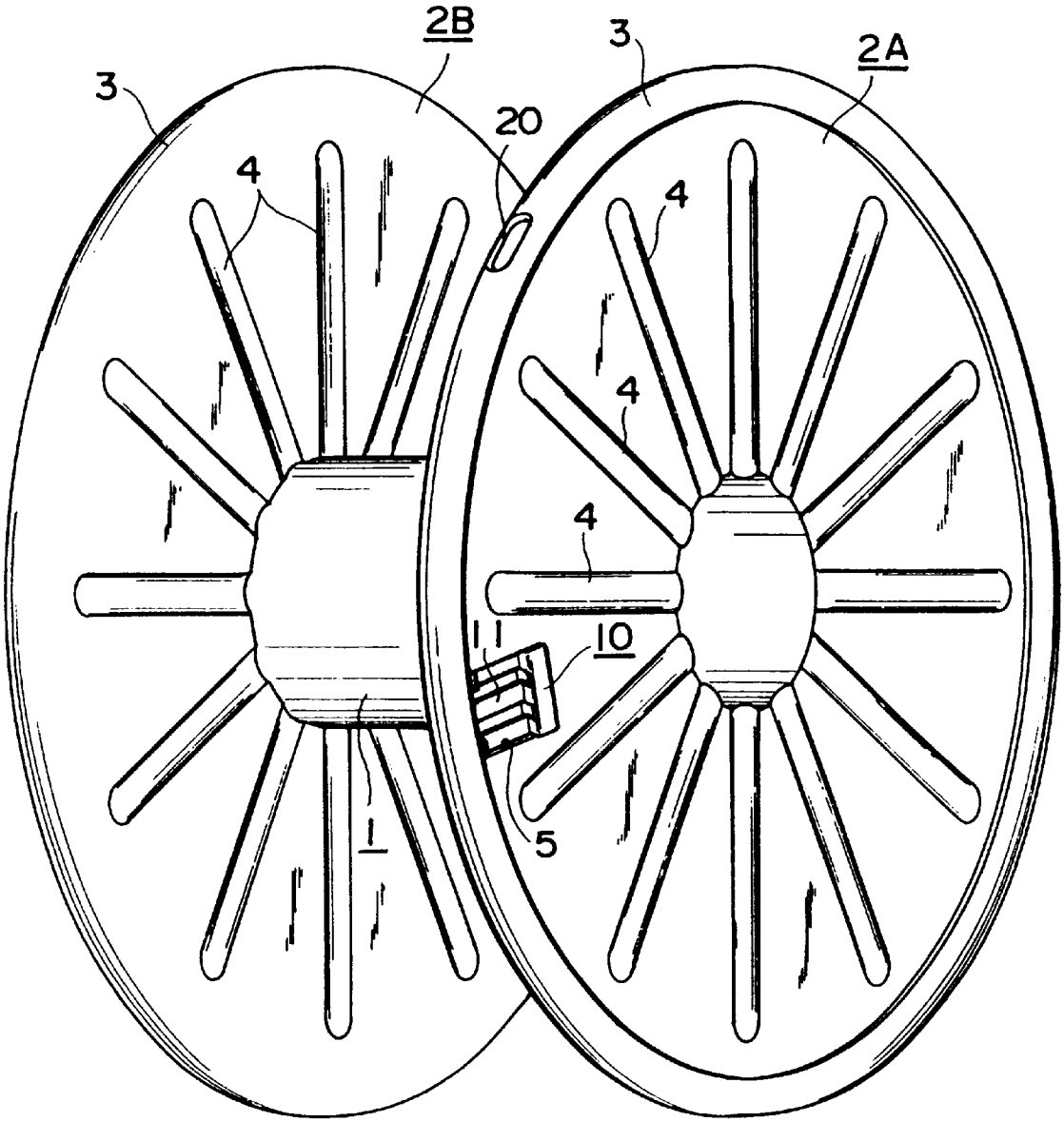
FIG. 1 is a perspective view illustrating the entirety of a cord take-up reel according to a first embodiment of the present invention.

As shown in FIG. 1, a reel for taking up a cord-like body comprises a cylindrical winding drum 1 and disk-shaped flanges 2A and 2B attached to respective ends of the winding drum 1. The winding drum 1 and flanges 2A and 2B generally are made of metal and the flanges 2A and 2B are fixed to the winding drum 1 by welding. The outer circumferential edge portion of each of the flanges 2A and 2B is turned (or folded) back on the outer side (the turned-back or folded-back portions are indicated at numerals 3). Further, each flange 2A, 2B is integrally formed to have a plurality of radiating reinforcing ribs 4. The ribs 4 define projections on the outer side of each flange and depressions on the inner side.

Figure 4:
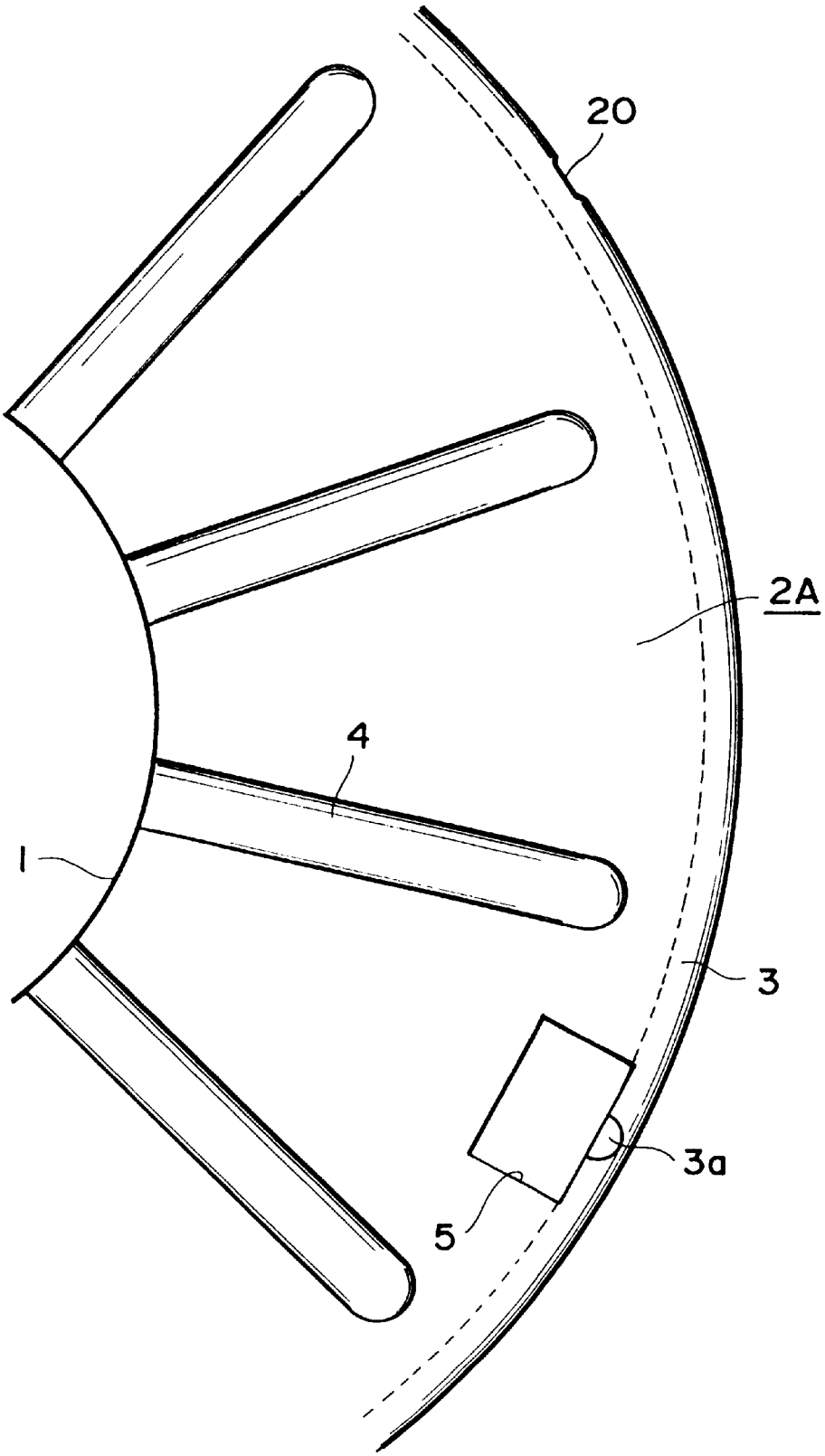
FIG. 4 is an enlarged plan view of the flange portion of the reel.

One of the flanges, namely flange 2A, is formed to have a window 5 near the outer circumferential portion of the flange (see FIG. 4 in particular). The upper edge (outer edge) of the window 5 substantially coincides with the inner edge of the folded-back portion 3. The inner side surface of the folded-back portion 3 is formed to have a small recess 3*a* at a position which corresponds to the center of the window 5 in terms of the width direction thereof. A cord retainer 10, described next, is accommodated within the window 5.

Figure 5A:
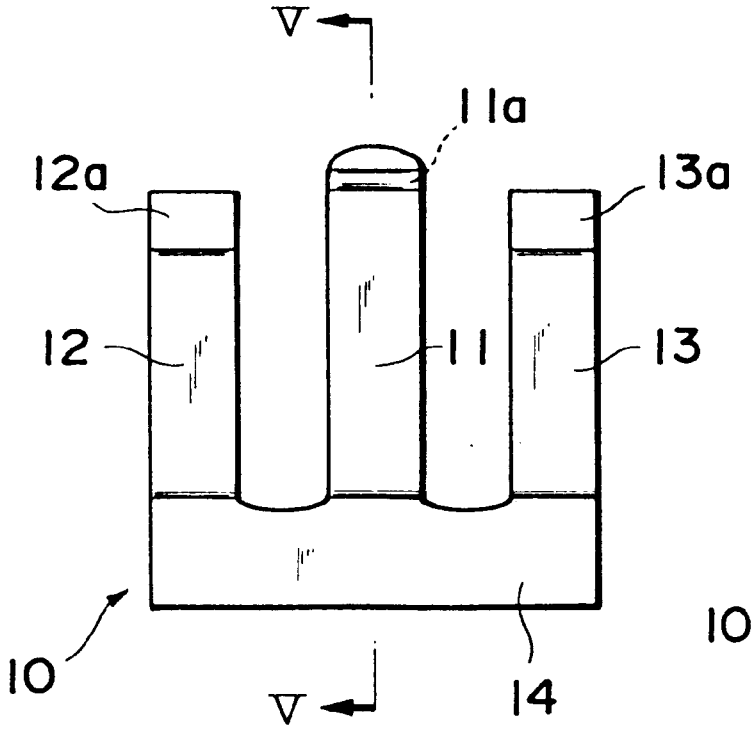
Figure 5B:
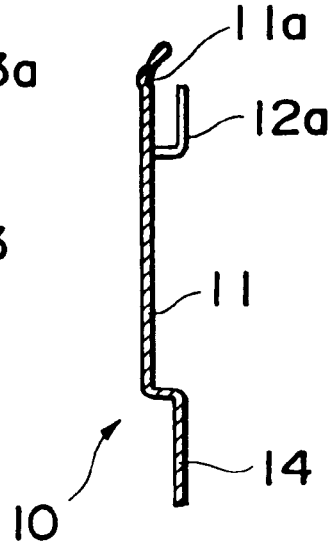

As shown in the enlarged views of FIGS. 5*a* and 5*b*, the cord retainer 10 comprises a central retaining finger 11, fixing fingers 12 and 13 provided in spaced-away relation, on either side of the central retaining finger 11, and a connecting piece 14 connecting the lower end portions of the retaining finger 11 and fixing fingers 12, 13. The cord retainer 10 consists of a resilient body made of steel or the like (or of carbon tool steel, described later in the second embodiment).

The central retaining finger 11 is the longest of the fingers and its distal end portion is bent in the outward direction [toward the right side in FIG. 5*b*]. A recess 11*a* which appears as a depression when seen from the outer side is formed in the vicinity of the distal end of the finger 11 traversely thereof. The recess 11*a* is large enough to receive at least a portion of the end of a cord-like body.

The connecting piece 14 is bent outwardly at right angles from the lower end portions (base portions) of the retaining finger 11 and the fixing fingers 12 and 13 and is bent again at right angles over a slight width so as to extend in parallel with the fingers 11~13. Distal ends 12*a* and 13*a* of the fixing fingers 12 and 13 are similarly bent outward at right angles and are bent again at right angles over a slight width so as to extend in parallel with the central portions of the fingers 12, 13. The width of these bent portions is approximately equal to the thickness of flange 2A.

The spacing between the outer edge of the fixing finger 12 and the outer edge of the fixing finger 13 of the cord retainer 10 is approximately equal to the width of the window 5. Further, the length from the location at which the fixing fingers 12 and 13 are bent at right angles to the location at which the connecting piece 14 is bent at right angles is approximately equal to the height of the window 5.

Figure 6:
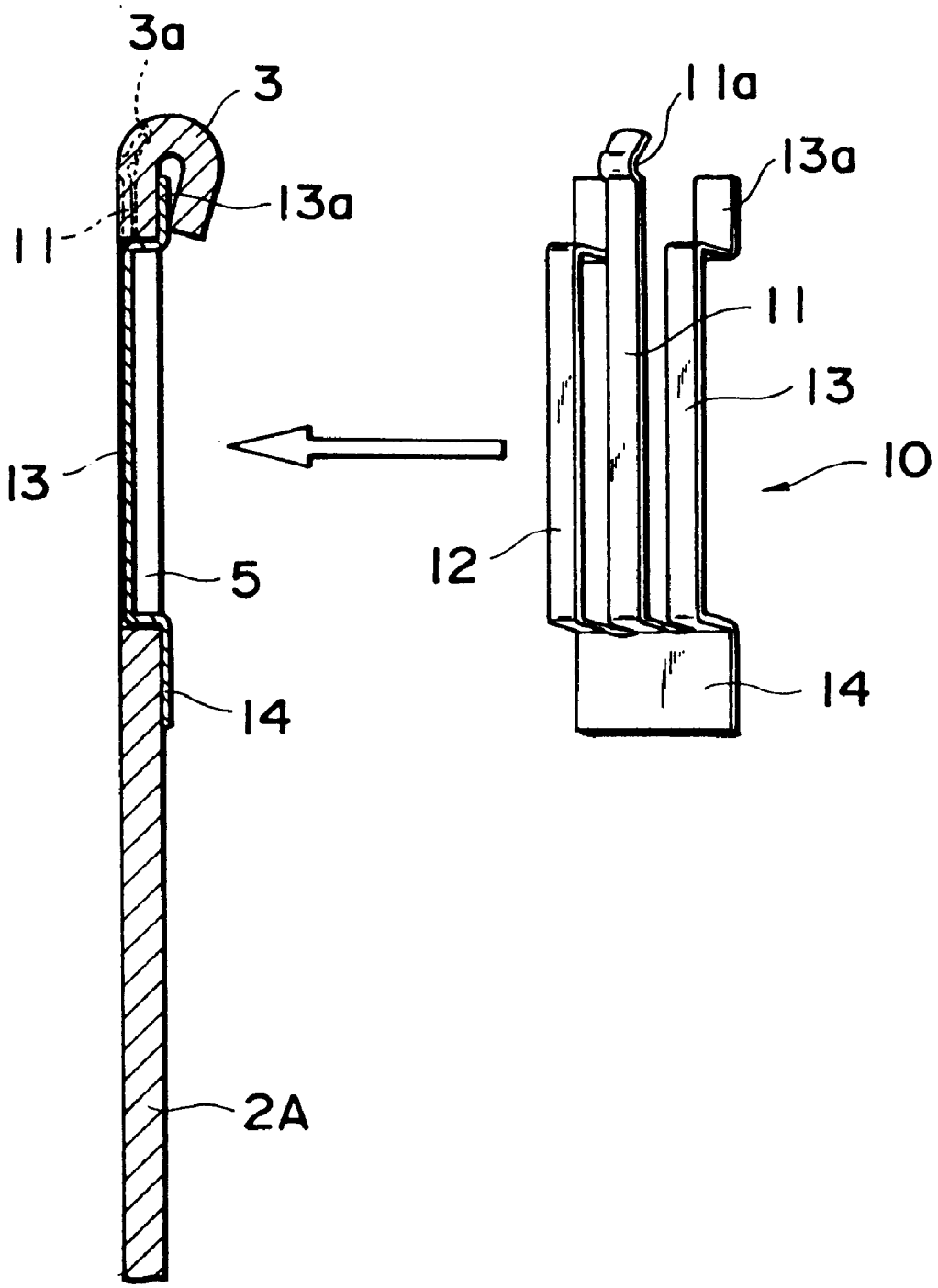
FIG. 6 is a sectional view showing the manner in which the cord retainer is attached to the flange.

The cord retainer 10 having this structure is fitted into the window 5 and secured to the flange 2A in the manner shown in FIG. 6.

The retaining finger 11 and fixing fingers 12, 13 are inserted into the window 5 from outside the flange 2A by passing the distal end portion of the central retaining finger 11 of cord retainer 10 through the window 5 from outside and making it lie on the inner surface of the outer circumferential edge portion (the folded-back portion 3) of flange 2A. A gap is provided beforehand between the distal end of the folded-back portion 3 and the outer surface of the flange 2A, and the distal ends 12*a* and 13*a* of the fixing fingers 12 and 13 are arranged along the outer surface of the upper edge of window 5 and are inserted into the gap. By strongly crimping or cramping the folded-back portion 3, the distal ends 12*a* and 13*a* of the fixing fingers 12 and 13 are strongly embraced and secured by the folded-back portion 3 and the outer surface of flange 2A. The connecting piece 14 of cord retainer 10 is arranged along the lower end of window 5 on the outer surface thereof. Since the distal ends 12*a*, 13*a* of fixing fingers 12, 13 and the connecting piece 14 are bent at right angles at two locations across a slight width, as described above, the retaining finger 11 and fixing fingers 12, 13 become substantially flush with the inner surface of the flange 2A.

As mentioned above, the inner surface of the outer circumferential edge of flange 2A is formed to have the recess 3*a*. The distal end portion of the retaining finger 11 fitted received in the window 5 fits into the recess 3*a*. As a result, the distal end portion of the retaining finger 11 also does not protrude (or almost does not protrude) inwardly from the inner side surface of the outer circumferential edge of flange 2A. Thus the distal end portion of the retaining finger 11 does not interfere with the operation through which the cord is taken up on the reel.

The connecting piece 14 of the cord retainer 10 is merely in abutting contact with the outer surface of the flange 2A, but is not fixed to the flange 2A by fixing means such as welding or riveting. If the connecting piece 14 were fixed to the flange 2A, stress would tend to concentrate in the lower end portion of the retaining finger 11 (namely in the vicinity of the boundary with the connecting piece 14) when the end of the cord is secured by the retaining finger 11. The lower end portion of the retaining finger 11 would develop fatigue over long use and would tend to break off. In this embodiment of the invention, stress produced when the end portion of the cord is retained is dispersed to the entirety of the connecting piece 14, the lower end of the retaining finger 11 and the vicinity of the lower ends of the fixing fingers 12 and 13 owing to the fact that the connecting piece 14 is not secured to the flange 2A. As a result, the service life of the cord retainer 10 is prolonged. In addition, the spring resilience with which the retaining finger 11 retains the end of the cord is enhanced.

Figure 2:
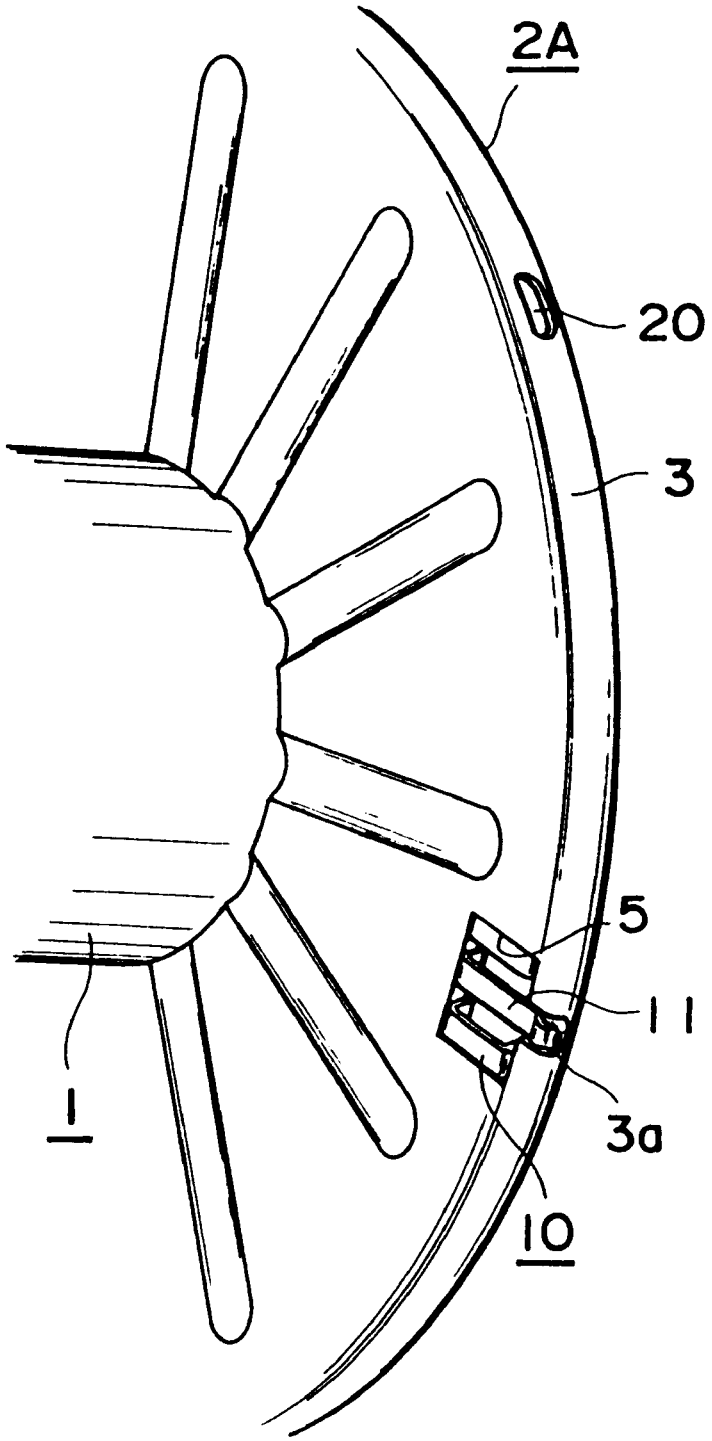
FIG. 2 is a perspective view in which a flange portion of the reel is seen from the inner side.

As best shown in FIGS. 1, 2 and 4, the outer circumferential edge (the folded-back portion 3) of flange 2A is formed to have a cord retaining slot (cord-end retaining portion) 20 at a position slightly offset (e.g., by 10~20 cm), in the cord take-up direction, from the position of the flange 2A at which the cord retainer 10 is provided.

Figure 7:
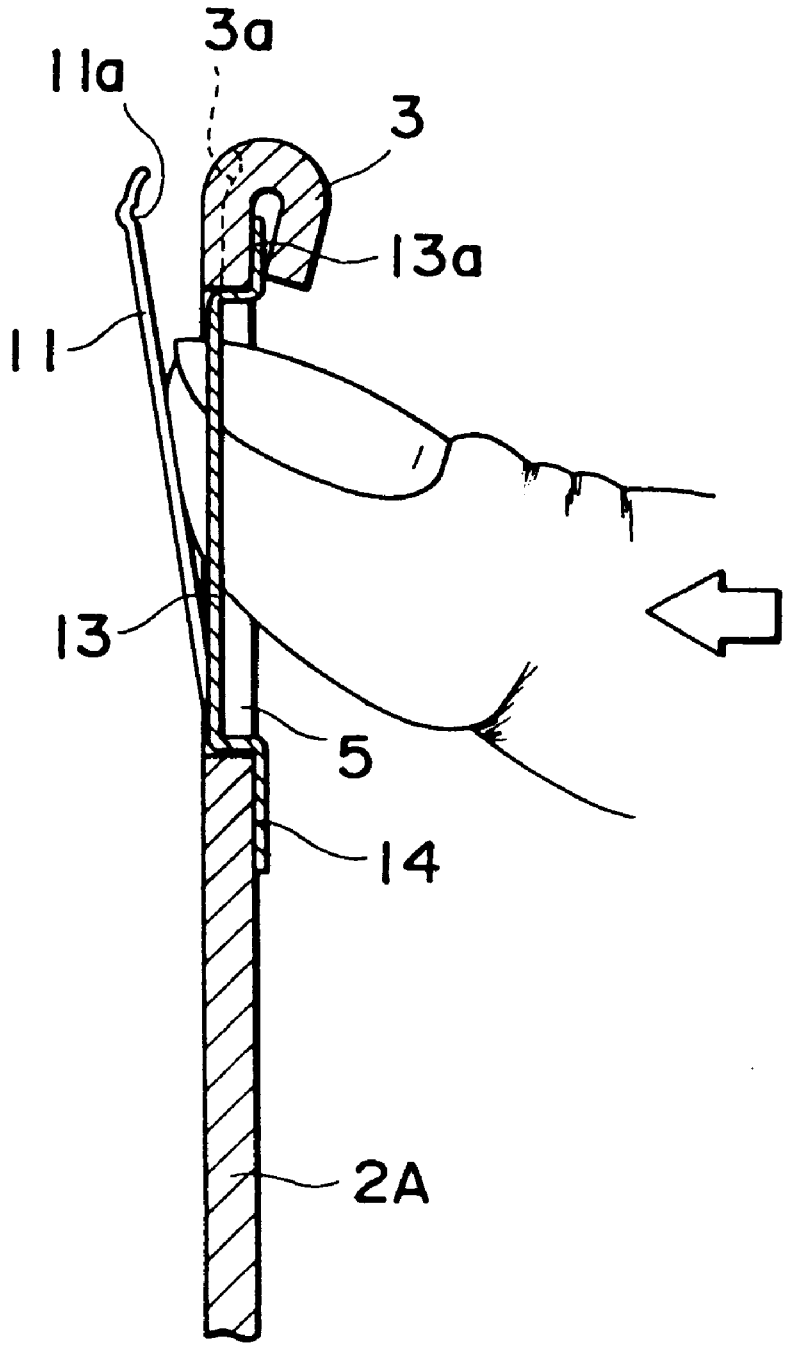
FIG. 7 is a sectional view showing how the end of a cord is fastened.
Figure 8:
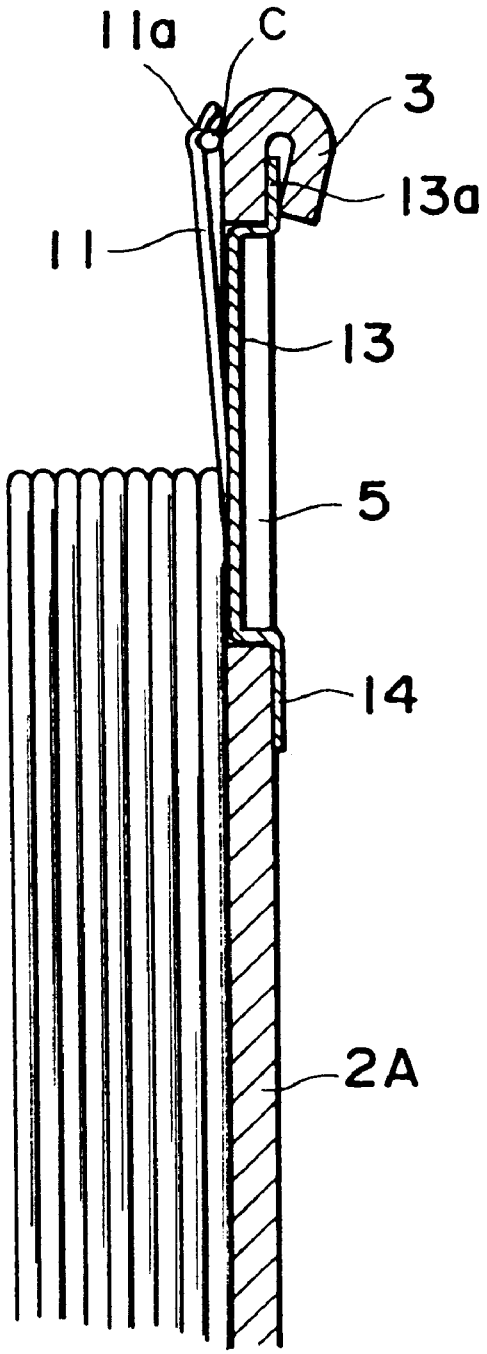
FIG. 8 is a sectional view showing the end of the cord in the secured state.

In a case where the end portion of the cord is to be secured after an appropriate amount of the cord has been taken up on the winding drum 1 of the reel, the retaining finger 11 of the cord retainer 10 is pushed inward from the outside of the flange 2A by the finger of the worker, as shown in FIG. 7. When this is done, the distal end of the retaining finger 11 parts from the inner surface of the outer circumferential edge of the flange 2A, thereby forming a gap or a clearance. If the end portion of the cord to be secured is inserted into the clearance and the force being exerted on the retaining finger 11 is released, the retaining finger 11 will return to its original state owing to its resiliency so that the end portion of the cord will be clamped and secured between the distal end of the retaining finger 11 and the inner surface of the outer circumferential edge of the flange 2A (see FIG. 8).

Since the distal end of the retaining finger 11 of cord retainer 10 is formed to have the recess 11*a*, the end portion of the cord fits into the recess 11*a* and is thereby secured reliably so that it will not come free. Further, even though the end portion of the cord is in a clamped state, the retaining finger 11 is not bent inwardly that much and an excess force does not act upon the vicinity of its lower end. Accordingly, there is little possibility that the retaining finger 11 will weaken or break off in this area. Since the connecting piece 14 is not fixed, stress acting upon the retaining finger 11 is dispersed, as mentioned above.

Figure 3:
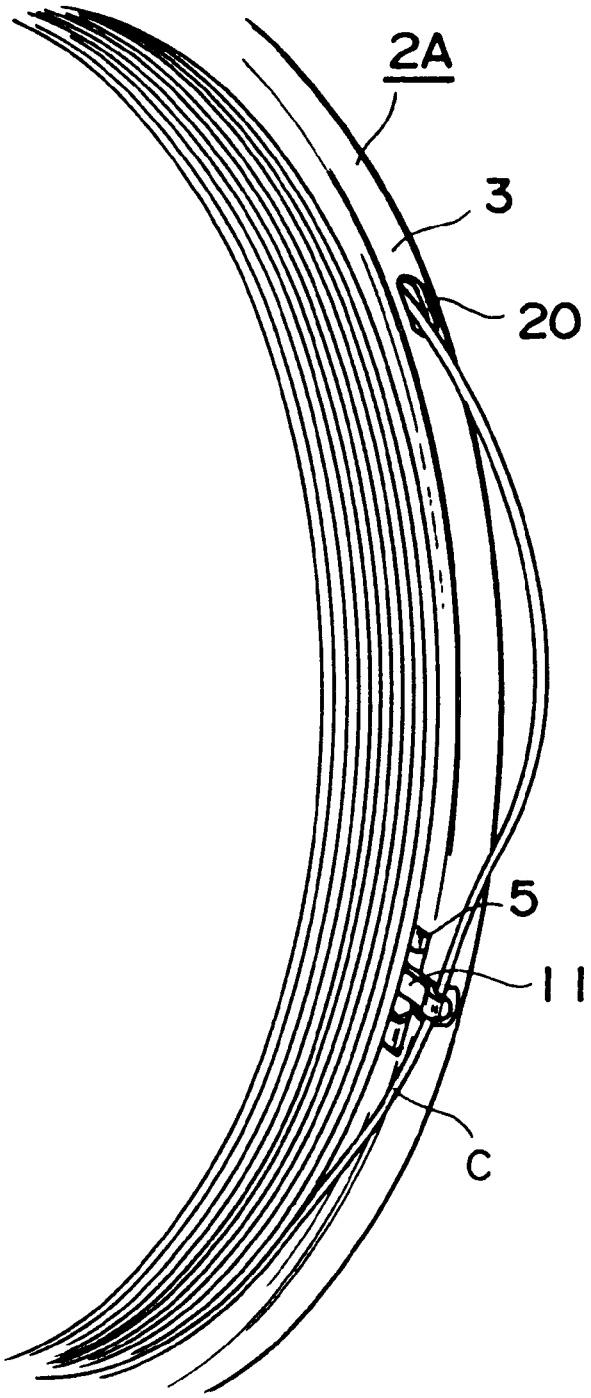
FIG. 3 is a perspective view showing a cord-like body that has been taken up on the reel.

The tip of the cord (the distal end thereof) ahead of the portion clamped by the retaining finger 11 is inserted into the slot 20, as shown in FIG. 3. As a result, it is possible to prevent accidents in which the end of the cord flies off the reel (in which case the end of the cord may injure the eye of a worker or contact and damage other reels during transport).

When the end portion of the cord is retained by the retaining finger 11, the retaining finger 11 can be pushed by part of a machine (a push rod or pusher, for example) rather than being pushed inwardly by the finger of the worker (see FIG. 7), as described above. In other words, not only the winding of the cord on the reel but also the fastening of the cord end can be performed automatically by machine. A device for automatically fastening the end of the cord will be described later.

The slot 20 for retaining the cord end need not necessarily be provided. The cord retainer 10 may be provided on the other flange 2B in addition to the flange 2A, in which case the slot 20 for retaining the cord end can be formed on the flange 2B as well. In a case where the cord retainer 10 (and the end retaining slot 20) is provided on both flanges 2A and 2B, it is preferred that the positional relationship between the cord retainers (and between the slots) be decided in such a manner that the end of a cord wound upon the reel in one direction can be fastened to either of the left and right flanges 2A and 2B.

Second Embodiment

FIGS. 9 through 12 illustrate a second embodiment of a reel for taking up a cord-like body according to the present invention.

Figure 9:
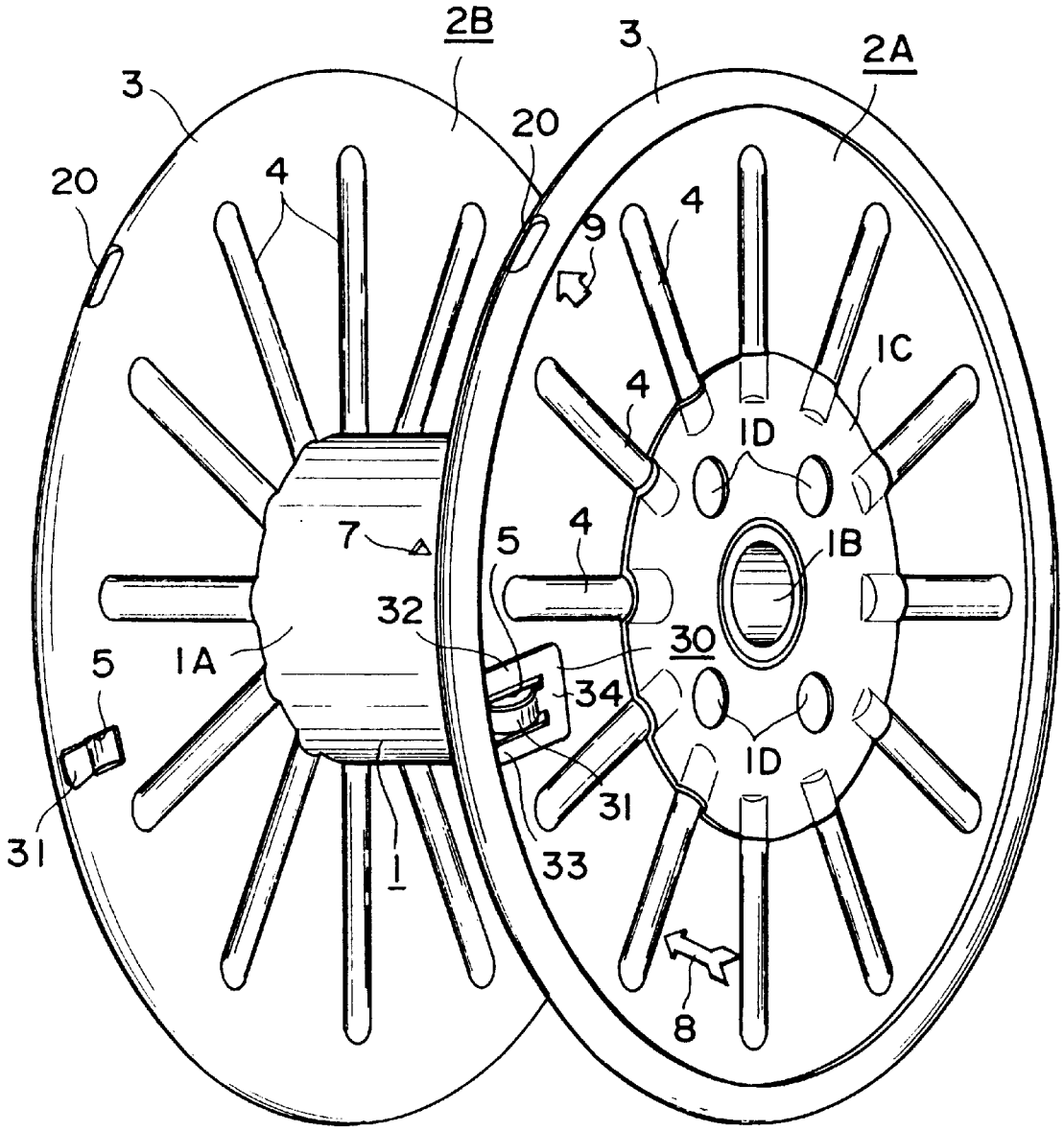
FIG. 9 is a perspective view illustrating the entirety of a cored take-up reel according to a second embodiment of the present invention.

As shown in FIG. 9, the reel according to the second embodiment comprises the cylindrical winding drum 1 and the disk-shaped flanges 2A and 2B attached to respective ends of the winding drum 1. This is the same as in the first embodiment.

The winding drum 1 is rigidly formed of two cylinders, namely an outer cylinder 1A and an inner cylinder 1B. Flanges 1C fixed to respective ends of the inner cylinder 1B of the winding drum 1 are welded to the flanges 2A and 2B by welding, respectively. A triangular hole 7 is formed in the outer cylinder 1A of the winding drum 1 substantially at the center thereof in terms of the longitudinal direction. The end of the cord to be taken up on the reel is inserted into the hole 7 and is engaged and anchored thereby. Owing to the triangular shape of the hole 7, the hole also indicates the take-up direction (which is the direction from the base to the apex of the triangle). The hole 7 need not necessarily be provided. The inner cylinder 1B of the winding drum 1 is used to mount the reel on a take-up shaft (a spindle or tail stock) or rewind shaft. Holes 1D formed in the flange 2A (and 2B) and 1C to surround the inner cylinder 1B are used to insert pins that are for the purpose of rotating the reel especially during cord take-up.

In a manner similar to that of the first embodiment, the flanges 2A and 2B are formed to include the plurality of radiating ribs 4. In this embodiment, windows 5 are formed in both flanges 2A and 2B at substantially corresponding positions. The upper edges (outer edges) of the Windows 5 also a situated at positions which substantially coincide with the inner edges of the folded-back portions 3 of the flanges 2A and 2B. The outer circumferential edges (folded-back portions 3) of the flanges 2A and 2B are formed to include the cord-end retaining slots 20 at locations spaced a suitable distance away, in the cord take-up direction, from the positions of the windows 5.

It is preferred that the cord take-up direction be clearly indicated on the surfaces of the flanges 2A and 2B, as indicated by the arrow 8. Further, it is preferred that a mark of the kind indicated by arrow 9 is provided in such a manner that the position of the slot 20 can be determined. It is also preferred that the position of the window 5 (a cord retainer 30) be clearly indicated in the same manner. (This is useful in a sensing operation performed by a cord retainer sensor, described later.) The arrows 8 and 9 can be provided by forming arrow-shaped protrusions on the flanges 2A and 2B or by affixing seals, on which arrows have been printed, to the flanges 2A and 2B.

The cord retainer 30 mounted in the window 5 and the operation through which the end portion of the cord is secured using the cord retainer 30 are the same for both the flanges 2A and 2B. Accordingly, the cord retainer 30 attached to flange 2A will be described below.

Figure 10A:
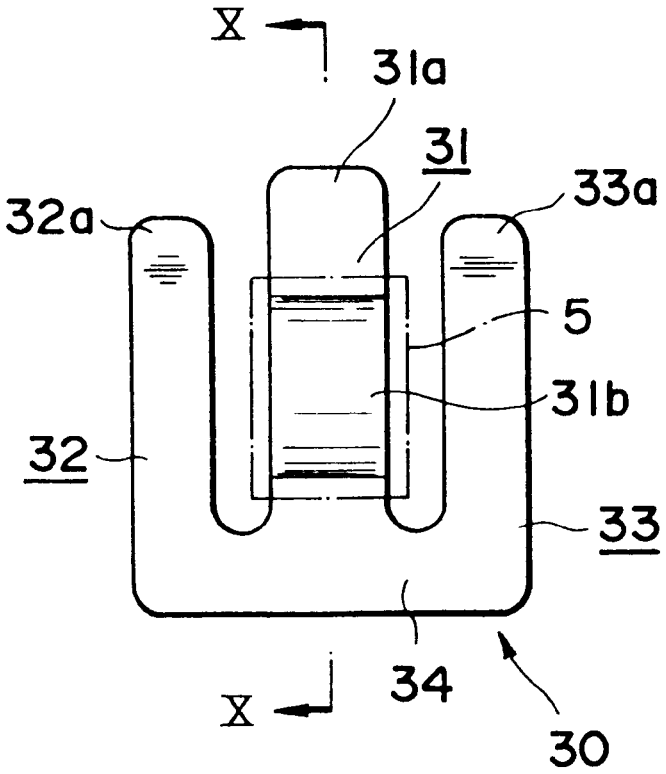
Figure 10B:
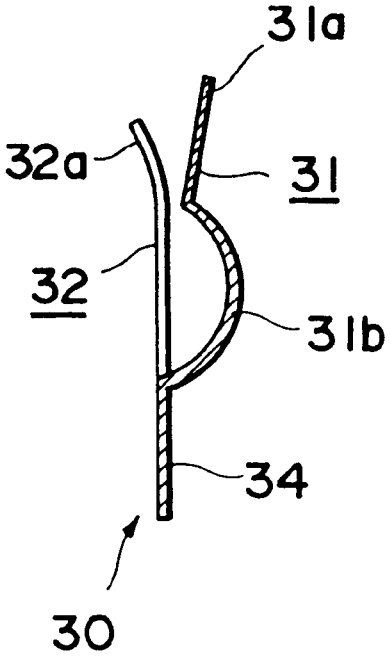

As shown in enlarged form in FIGS. 10*a* and 10*b*, the cord retainer 30 comprises a central retaining finger 31, fixing fingers 32 and 33 provided in spaced-apart relation on either side of the central retaining finger 31, and a connecting piece 34 connecting the lower end portions of the retaining finger 31 and fixing fingers 32, 33. The cord retainer 30 consists of a hard resilient body.

It is preferred that the cord retainer 30 be made of carbon tool steel JIS SK5 (ISO TC90, TC80) (AISI ASTM W1–8). The composition of JIS SK5 is, in terms of percent by weight, 0.8~0.9 C, no more than 0.35 Si, no more than 0.50 Mn, no more than 0.03 P, no more than 0.03 S, and the remainder Fe. The cord retainer preferably is subjected to a heat treatment to raise its hardness and spring-like property. For example, a Rockwell hardness HRc of greater than 30 could be obtained as the result of quenching carbon tool steel SK5 at 820° C. for 45 min, subsequently carrying out annealing at 570° C. for 60 min and allowing the steel to cool in air. The quenching and annealing heat treatment has the advantage of reducing variance in the hardness obtained. It was determined by experiment that the cord retainer could withstand practical use satisfactorily at a Rockwell hardness HRc of 27 or greater. A Rockwell hardness HRc of 30 or greater is preferred. Using the cord retainer 30 having this high hardness provides excellent cord-end securing performance and excellent service durability.

The central retaining finger 31 is longer than the fixing fingers 31 and 32. A semi-circular or arcuate pushing portion 31*b* is formed on the retaining finger 31 at the central portion thereof in terms of the longitudinal direction. The length of the pushing portion 31*b* is somewhat less than the height of the window 5 formed in the flange 2A. Further, the width of the retaining finger 31 is formed to be slightly smaller than the width of the window 5. The overall retaining finger 31 is curved slightly in the direction in which the pushing portion 31*b* protrudes [namely rightward in FIG. 10*b*].

Distal ends 32*a*, 33*a* of the fixing fingers 32, 33 are bent slightly in the direction [leftward in FIG. 10*b*] opposite that in which the pushing portion 31*b* of the retaining finger 31 protrudes.

Figure 11:
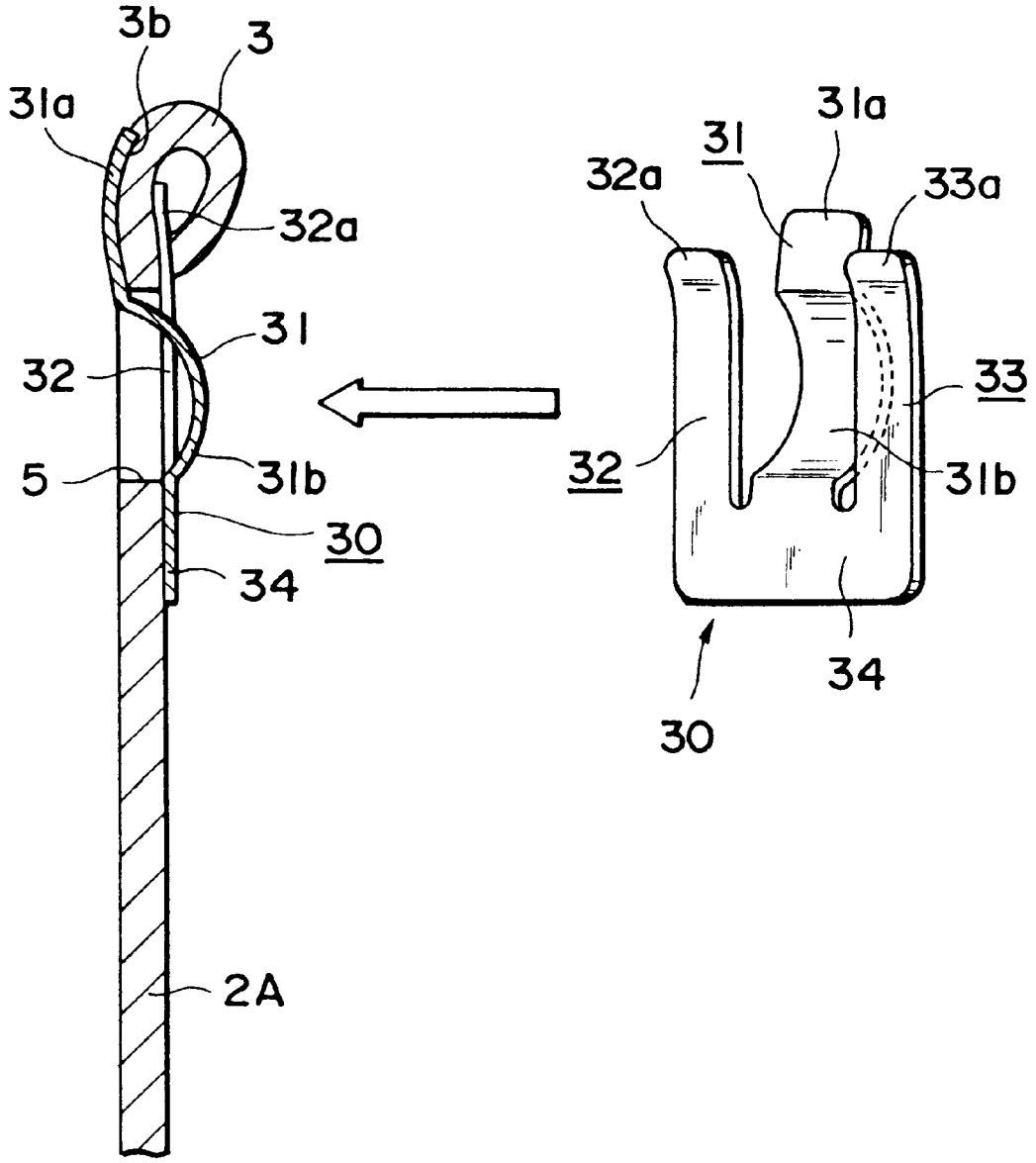
FIG. 11 is a sectional view showing the manner in which the cord retainer is attached to the flange.
Figure 12:
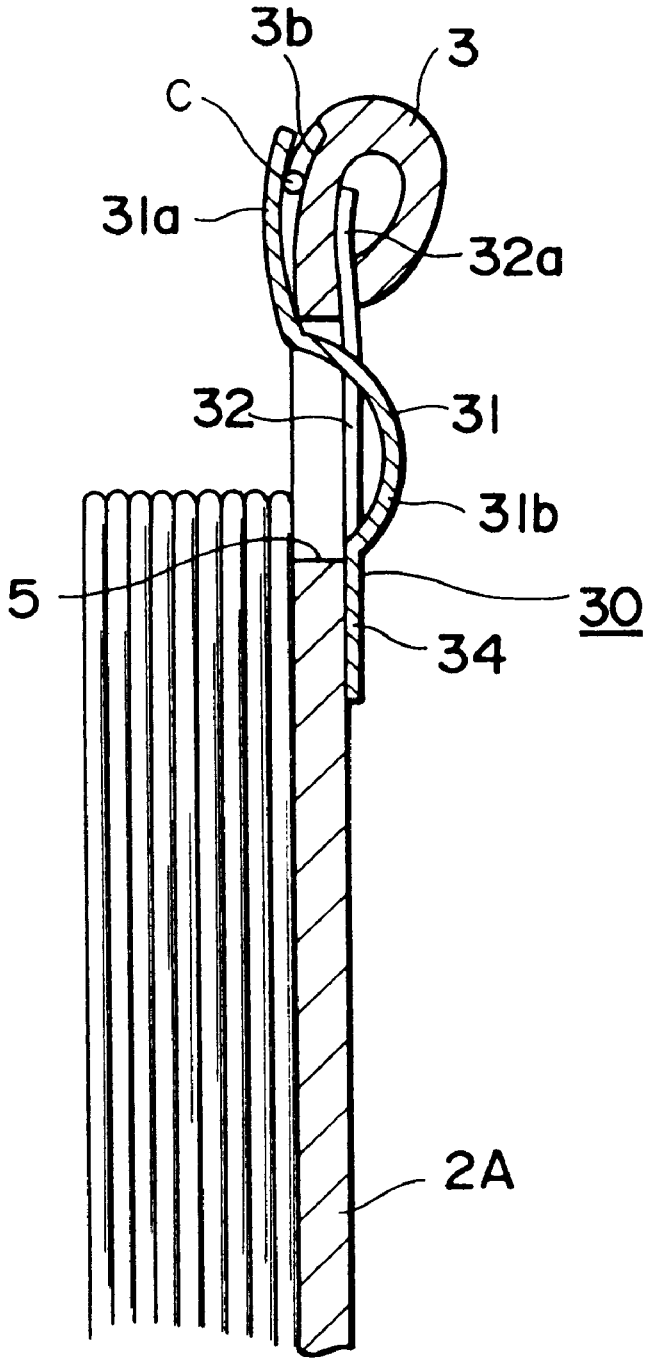
FIG. 12 is a sectional view showing the end of the cord in the secured state.

The cord retainer 30 is secured to the flange 2A in the manner shown in FIG. 11. The distal end 31*a* of the retaining finger 31 is brought inside the flange 2A from the outside thereof through the window 5, and the fixing fingers 32, 33 and connecting piece 34 are made to lie on the outer surface of the flange 2A at the periphery of the window 5. The distal ends 32*a*, 33*a* of the fixing fingers 32, 33 are inserted into a gap formed between the end of the folded-back portion 3 and the outer surface of the flange 2A. Since the folded-back portion 3 is folded back by being curved slightly inward from the outer edge portion of the flange 2A, the bent distal end portions 32*a*, 33*a* of the fixing fingers 32, 33 lie on the inner surface of this slightly curved folded-back portion 3.

By strongly crimping the folded-back portion 3, the distal ends 32*a* and 33*a* of the fixing fingers 32 and 33 are strongly embraced by the edge of the folded-back portion 3 and the outer surface of flange 2A. The pushing portion 31*b* of the retaining finger 31 protrudes outwardly of the flange 2A from the window 5. It is preferred that the crimping operation be performed after first temporarily affixing the cord retainer 30 to the outer surface of the flange 2A as by a bonding agent.

The cord retainer 30 is formed from a hard material. When the folded-back portion 3 is strongly crimped, the distal end portion 31*a* of the retaining finger 31 of cord retainer 30 deforms the folded-back portion 3 slightly and a small recess 3*b* which receives this distal end portion 31*a* is formed on the inner side surface of the folded-back portion 3. Further, the distal end portion 31*a* of the retaining finger 31 is curved slightly so as to lie in the recess 3*b* of the folded-back portion 3. Furthermore, since the overall retaining finger 31 is bent with respect to the connecting piece 34, its distal end portion 31*a* is urged strongly into the recess 3*b* of the flange 2A. Since the distal end portion 31*a* of the retaining finger 31 does not project inwardly from the flange 2A, it does not interfere with the operation through which the cord is taken up on the reel.

It goes without saying that the recess 3*b* of the folded-back portion 3 and the curvature of the distal end portion 31*a* of retaining finger 31 may be formed in advance.

In a case where the end portion of the cord is to be secured after an appropriate amount of the cord has been taken up on the winding drum 1 of the reel, the pushing portion 31*b* of the retaining finger 31 of the cord retainer 30 is pushed inward from the outside of the flange 2A by the finger of the worker. When this is done, the distal end 31*a* of the retaining finger 31 parts from the inner surface of the outer circumferential edge (folded-back portion 3) of the flange 2A, thereby forming a clearance. If the end portion of the cord to be secured is inserted into the clearance and the force being exerted on the retaining finger 31 is released, the retaining finger 31 will return to its original state owing to its resiliency so that the end portion C of the cord will be clamped and secured between the distal end 31*a* of the retaining finger 31 and the inner surface of the outer circumferential edge of the flange 2A (see FIG. 12).

In this embodiment also the connecting piece 34 of the cord retainer 30 is merely in abutting contact with the outer surface of the flange 2A, but is not fixed to the flange 2A by fixing means such as welding or riveting. Accordingly, stress produced when the end portion of the cord is retained is dispersed to the entirety of the connecting piece 34, the lower end of the retaining finger 31 and the vicinity of the lower ends of the fixing fingers 32 and 33. As a result, the service life of the cord retainer 30 is prolonged. In addition, the spring resilience with which the retaining finger 31 retains the end portion of the cord is enhanced.

The tip of the cord (the distal end thereof) ahead of the portion clamped by the retaining finger 31 is inserted into the slot 20.

The retaining finger 13 can be urged by part of a machine (a push rod, for example) rather than being pushed inwardly by the finger of the worker. Not only the winding of the cord on the reel but also the fastening of the cord end can be performed automatically by machine. This is the same as in the cord take-up reel of the first embodiment.

It goes without saying that the cord retainer 30 and slot 20 may be provided on only one of the flanges 2A and 2B. The retaining finger 31 of the cord retainer 30 may be formed to have a recess, which corresponds to the recess 11*a* of the first embodiment, for the purpose of receiving the end portion of the cord.

Third Embodiment

FIGS. 13 through 22 illustrate a third embodiment of a reel for taking up a cord-like body according to the present invention.

Figure 13:
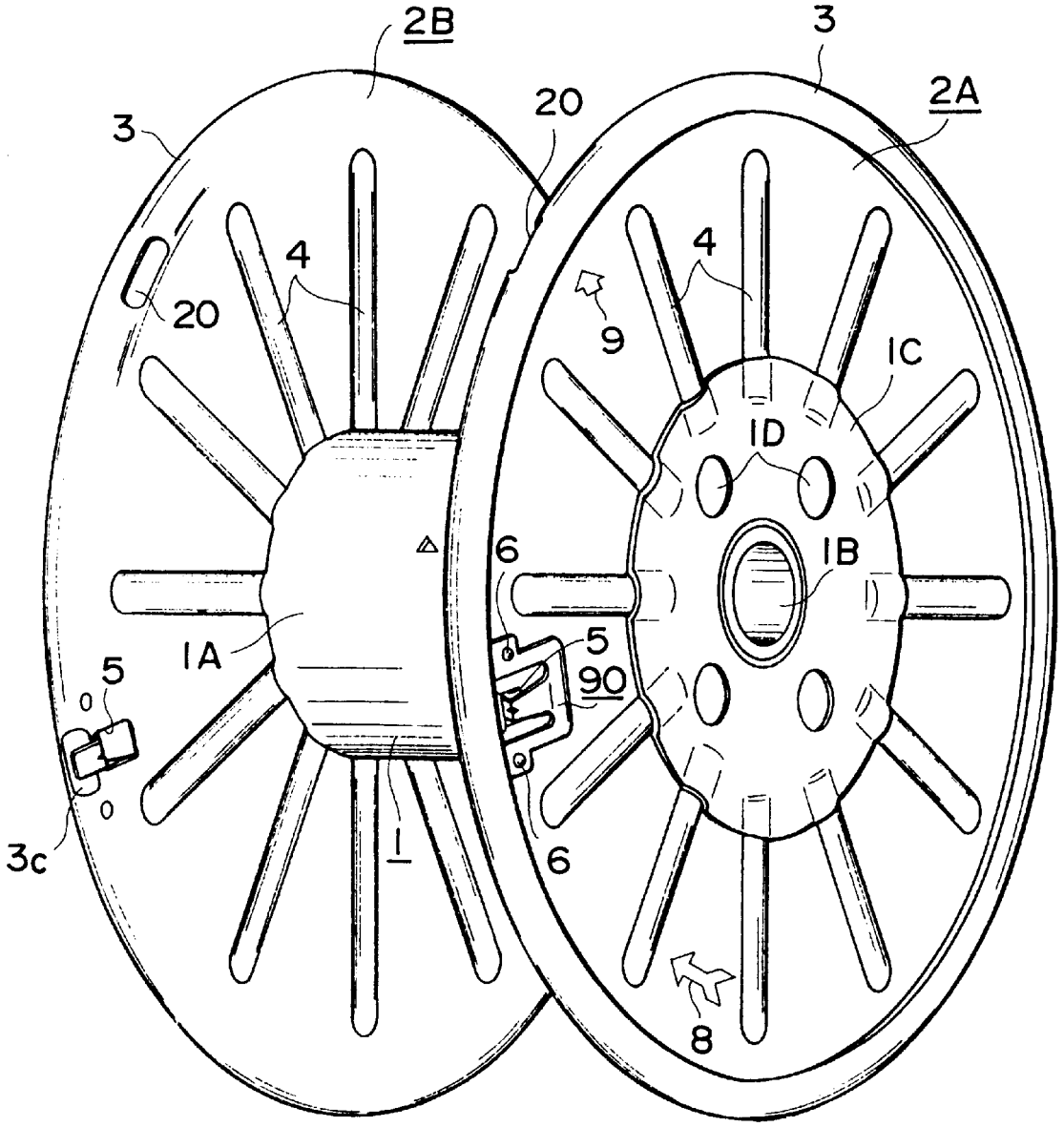
FIG. 13 is a perspective view illustrating the entirety of a cord take-up reel according to a third embodiment of the present invention.

In FIG. 13, the cord take-up reel comprises the cylindrical winding drum 1 and the disk-shaped flanges 2A and 2B attached to the respective ends of the winding drum 1, and has basically the same structure as that of the cord take-up reel shown in FIG. 9, so that the same description will not be repeated.

The flanges 2A and 2B are respectively formed to have windows 5 near the outer circumferential portions of the flanges at substantially corresponding positions. The upper edges (outer edges) of the windows 5 substantially coincide with the inner edges of the folded-back portions 3. The inner side surfaces of the folded-back portions 3 are formed with recesses 3*c* at positions corresponding to the windows 5, respectively. Wire clips (cord retainers) 90, which will be described later in detail, are attached to the flanges 2A and 2B at positions centered by the windows 5, respectively. Each of the flanges 2A and 2B is formed to have projections 6 which protrude outwardly at positions both sides of the window 5.

The outer circumferential edges (the folded-back portion 3) of the flanges 2A and 2B are formed to have the cord retaining slots (the code-end retaining portion) 20 at positions spaced appropriate distances away from the positions of the windows 5 in the cord take-up direction, respectively. The cord retaining slots 20 are located inside the outermost circumferential edges of the folded-back portions 3 of the flanges 2A and 2B (see FIG. 27).

The structure of the wire clips 90 and the operation through which the end portion of the cord is fixed using the wire clips 90 are the same for both the flanges 2A and 2B, so that the wire clip 90 attached to the flange 2A will be explained below.

Figure 14:
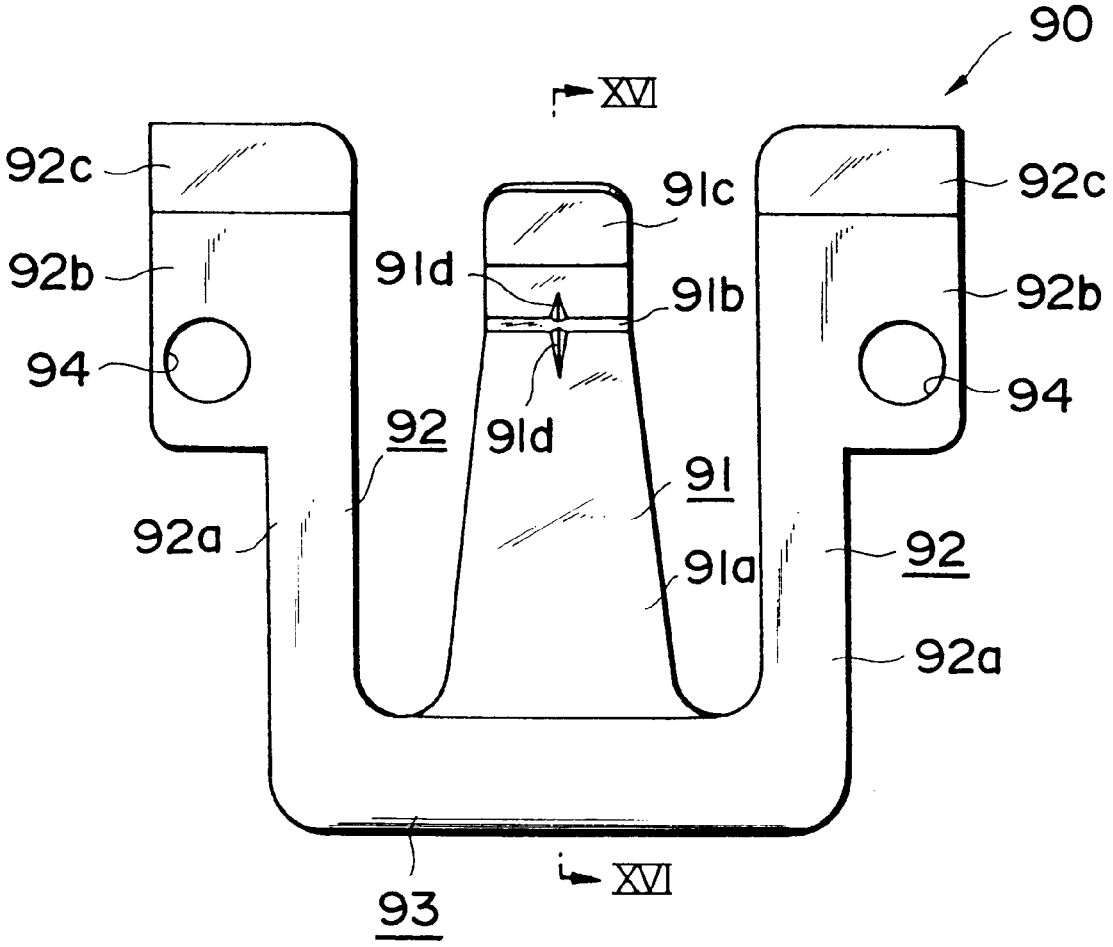
FIG. 14 is a front view of a wire clip according to the third embodiment.
Figure 15:
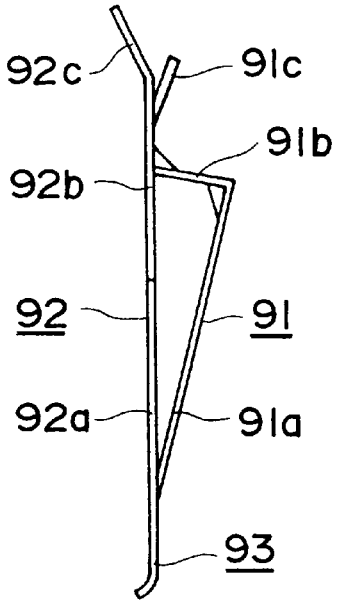
FIG. 15 is a side view of the wire clip according to the third embodiment.
Figure 16:
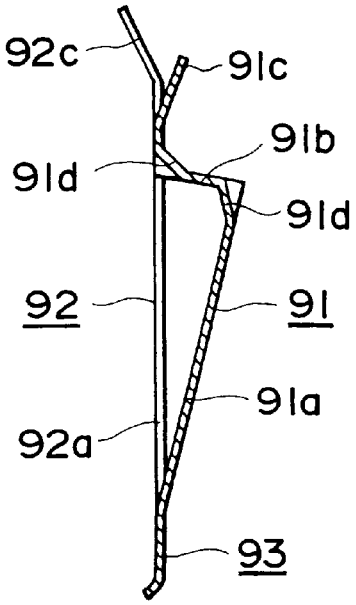
FIG. 16 is a sectional view taken along line XVI—XVI of FIG. 14.
Figure 17:
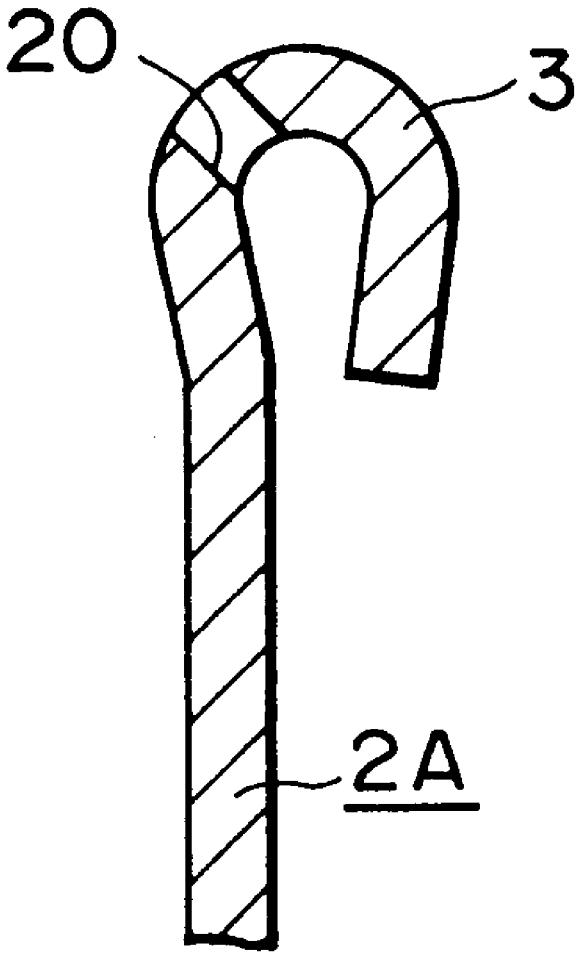
FIG. 17 is a sectional view for illustrating a cord retaining slot.

As shown in enlarged form in FIGS. 14 to 16, the wire clip 90 comprises a central retaining finger 91, attaching fingers 92 provided in spaced-apart relation on either side of the central retaining finger 91, and a connecting piece 93 connecting the lower end portions of the retaining finger 91 and the attaching fingers 92. The wire clip 90 is made of a resilient material such as steel, for example, SUS304H, SUS634, being subjected to heat treatment for two hours, which results in hardness of HRc 32.

The central retaining finger 91 is shorter than the attaching fingers 92 on both sides when viewed from front. The retaining finger 91 slops outward (portion 91*a*) from the boundary with the connecting piece 93, bends inward (portion 91*b*) in the distal end thereof, and finally is directed toward outside (portion 91*c*). The retaining finger 91 is integrally formed to have reinforcing ribs 91*d* at the boundary between the portions 91*a* and 91*b* and the boundary between the portions 91*b* and 91*c*.

The attaching fingers 92 are relatively narrow (portion 92*a*) in width in the vicinity of the portions connected to the connecting piece 93 and are wide (portions 92*b* and 92*c*) in width in the distal end portions and in the neighborhood thereof. The distal end portions (portions 92*c*) are bent inward. The attaching fingers 92 are formed to have positioning holes 94 at the wide portion 92*b* thereof. The lower end of the connecting piece 93 is curved inward.

Figure 18:
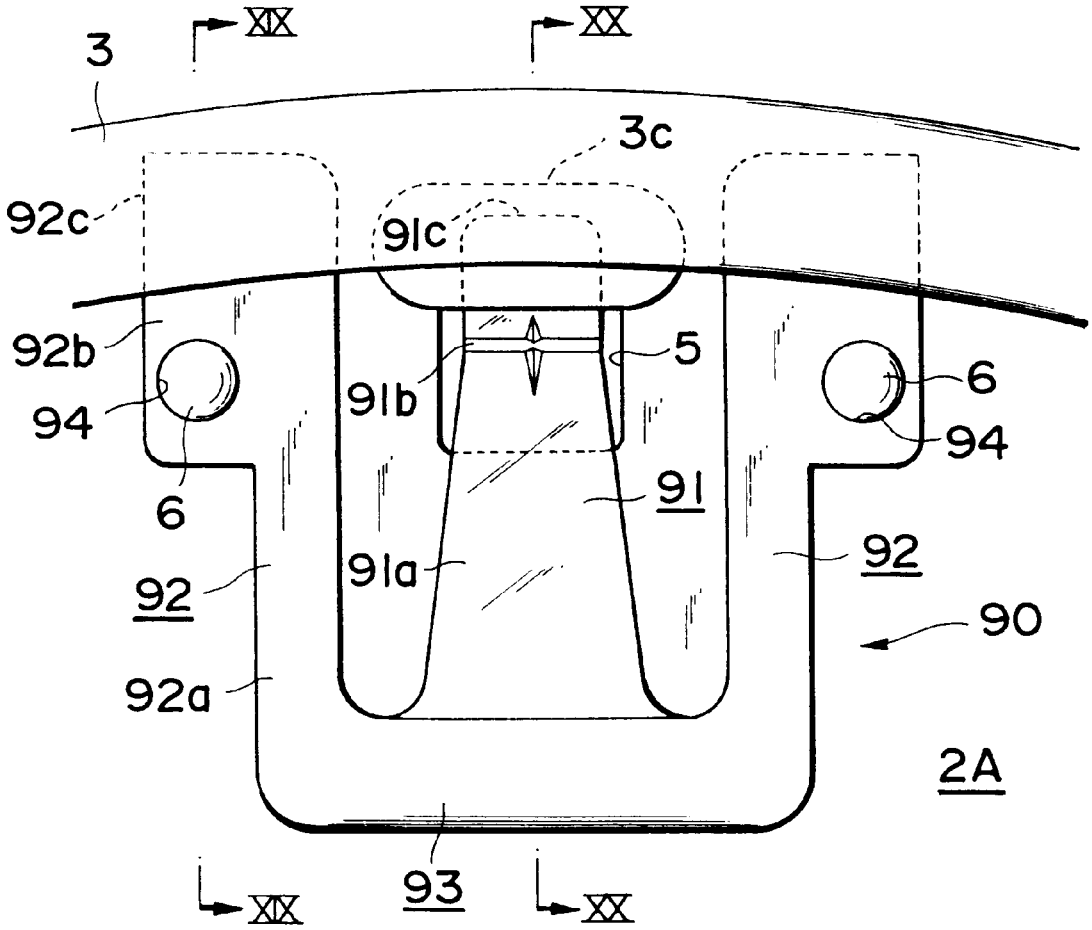
FIG. 18 is a front view showing the wire clip attached to the cord take-up reel.
Figure 19:
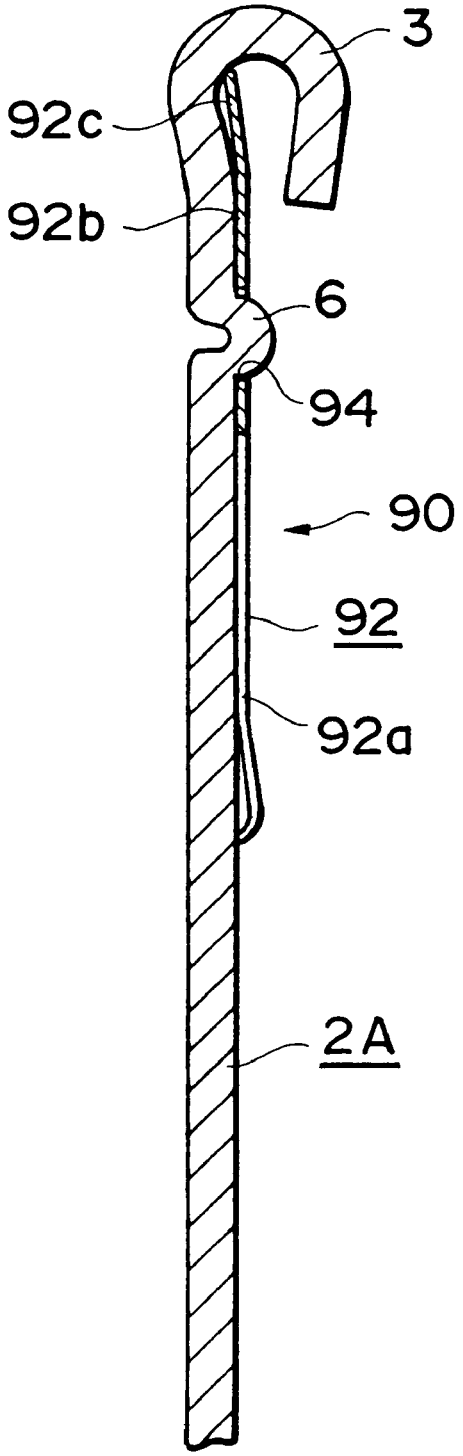
FIG. 19 is a sectional view taken along line XIX—XIX of FIG. 18.
Figure 20:
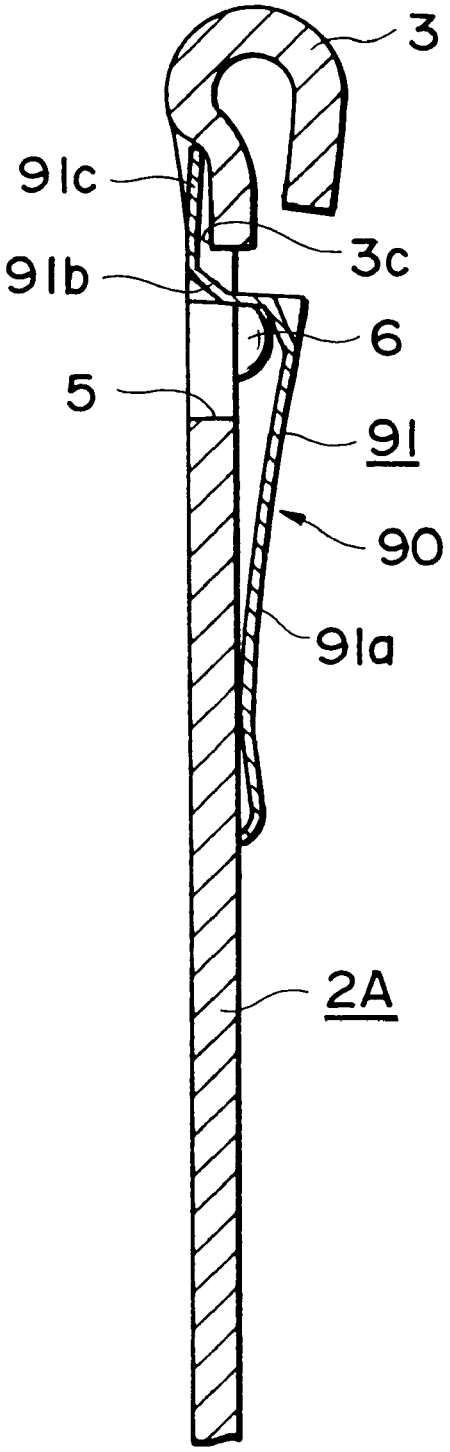
FIG. 20 is a sectional view taken along line XX—XX of FIG. 18.

The wire clip 90 is attached to the cord take-up reel on the area centered by the window 5 as shown in FIGS. 18 to 20. That is, the distal ends of the attaching fingers 92 of the wire clip 90 are inserted into the folded-back portion 3 along the outer circumferential edges of the flange 2A from the outside of the flange 2A of the cord take-up reel, and the distal end of the retaining finger 91 is inserted into the window 5. The projections 6 of the flange 2A is fitted into the holes 94 of the attaching fingers 92. The wire clip 90 is attached and secured to the reel for taking up the cord-like body owing to the resilience the wire clip 90 has. Namely, no special means for securing the wire clip 90 (e.g., means for welding, riveting or crimping) is necessary. Of course, the distal ends of the attaching fingers 92 may be strongly fixed by crimping the folded-back portion 3 of the flange 2A. Only the distal end portions 91*b* and 91*c* of the retaining finger 91 are brought inside the window 5 and the other portions and fingers (the portion 91*a* of the retaining finger 91, and the attaching fingers 92 and the connecting piece 93) urge the flange 2A from outside. The distal end portion 91*c* of the retaining finger 91 is brought into contact with the recess 3*c* to urge from inside toward outside. In this way, the wire clip 90 is securely fixed to the flange 2A. Since the projections 6 are fitted into the holes 94, the wire clip 90 is neither shifted nor slided.

As described above, the flange 2A is formed to have the recess 3*c* on the inner surface of the outer circumferential edge thereof. The distal end 91*c* of the retaining finger 91 brought inside the window 5 is accommodated into the recess 3*c*, so that the distal end 91*c* of the retaining finger 91 does not project (or does not substantially project) inwardly from the inner surface of the flange 2A. The distal end 91*c* of the retaining finger 91 does not interfere with the operation through which the cord is taken up on the reel.

The connecting piece 93 of the wire clip 90 is merely in abutting contact with the outer surface of the flange 2A, but is not fixed to the flange 2A by fixing means such as welding or riveting. If the connecting piece 93 were fixed to the flange 2A, stress would tend to concentrate in the lower end portion of the retaining finger 91 (namely in the vicinity of the boundary with the connecting piece 93) when the end of the cord is secured by the retaining finger 91. The lower end portion of the retaining finger 91 would develop fatigue over long use and would tend to break off. In this embodiment of the invention, stress produced when the end portion of the cord is retained is dispersed to the entirety of the connecting piece 93, the lower end of the retaining finger 91 and the vicinity of the lower ends of the attaching fingers 92 owing to the fact that the connecting piece 93 is not secured to the flange 2A. As a result, the service life of the wire clip 90 is prolonged. In addition, the spring resilience with which the retaining finger 91 retains the end of the cord is enhanced.

Figure 21:
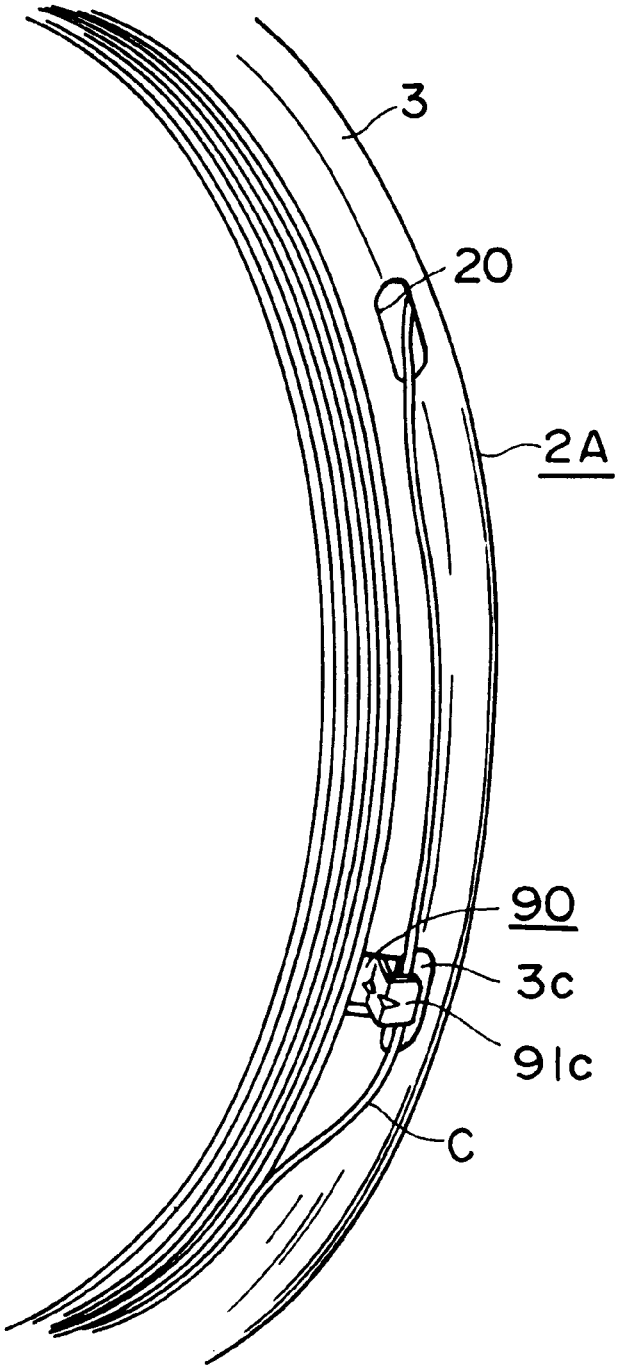
FIG. 21 is a perspective view showing the state in which a cord end is secured.
Figure 22:
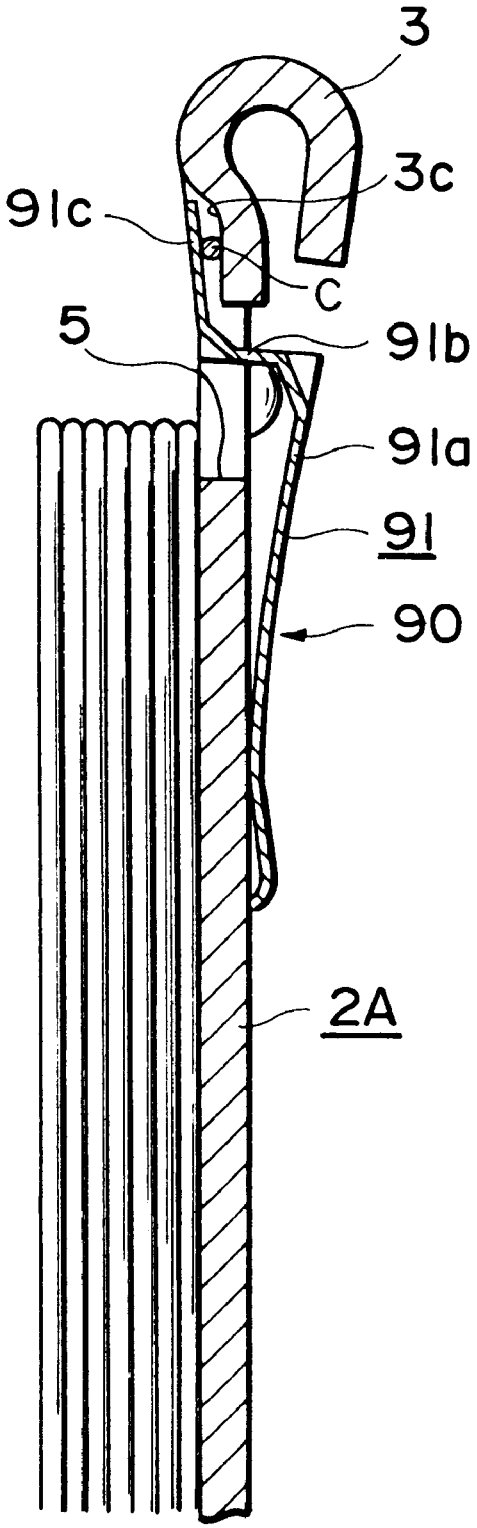
FIG. 22 is a sectional view showing the end of the cord in the secured state.

With reference to FIGS. 21 and 22, in a case where the end portion of the cord is to be secured after an appropriate amount of the cord has been taken up on the winding drum 1 of the reel, the retaining finger 91 of the wire clip 90 is pushed inward from the outside of the flange 2A by the finger of the worker. When this is done, the distal end 91*c* of the retaining finger 91 parts from the inner surface (the recess 3*c*) of the outer circumferential edge of the flange 2A, thereby forming a gap or a clearance. If the end portion of the cord to be secured is inserted into the clearance and the force being exerted on the retaining finger 91 is released, the retaining finger 91 will return to its original state owing to its resiliency so that the end portion of the cord C will be clamped and secured between the distal end 91*c* of the retaining finger 91 and the inner surface of the outer circumferential edge of the flange 2A.

The tip of the cord (the distal end thereof) ahead of the portion clamped by the retaining finger 91 is inserted into the slot 20, as shown in FIG. 21. As a result, it is possible to prevent accidents in which the end of the cord flies off the reel (in which case the end of the cord may injure the eye of a worker or contact and damage other reels during transport). Further, since the slot 20 is formed inner side the outermost top of the circumferential edge of the flange, the tip of the cord does not protrude outside the flanges 2A and 2B. Even when the reel rolls on a floor, the tip of the cord does not beat the floor, etc.

When the end portion of the cord is retained by the retaining finger 91, the retaining finger 91 can be pushed by part of a machine (a push rod or pusher, for example), as described later, rather than being pushed inwardly by the finger of the worker. In other words, not only the winding of the cord on the reel but also the fastening of the cord end can be performed automatically by machine.

The wire clip 90 is attachable to and detachable from the cord take-up reel. The wire clip attached to the reel can be easily replaced with new one, when the wire clip 90 attached to the reel cannot be used any more due to, e.g., development of metal fatigue.

The cord retaining slot 20 may not be necessarily provided. The wire clip 90 may be provided on only one flange 2A.

Figure 23:
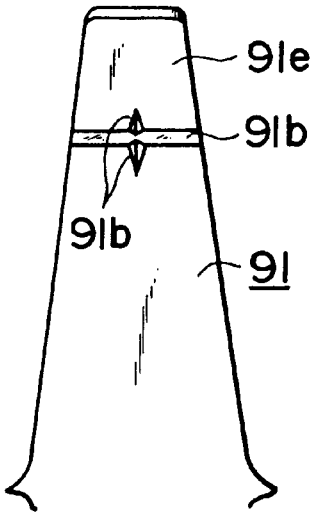
FIG. 23 shows a modification and illustrates a retaining finger of a wire clip.

FIG. 23 shows a modification. The width of the distal end portion 91*c* of the retaining finger 91 is constant in the above mentioned third embodiment, so that a force enough to clamp the cord end can be secured. However, a distal end portion 91*e* of the retaining finger 91 may be narrower as the tip is approached as shown in FIG. 23.

Figure 24:
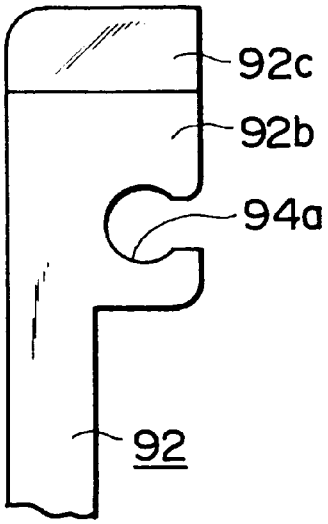
FIG. 24 shows another modification and illustrates an attaching finger of a wire clip.

FIG. 24 shows another modification. The hole 94 of the attaching finger 92 is replaced with a cut-out 94*a*.

Figure 25:
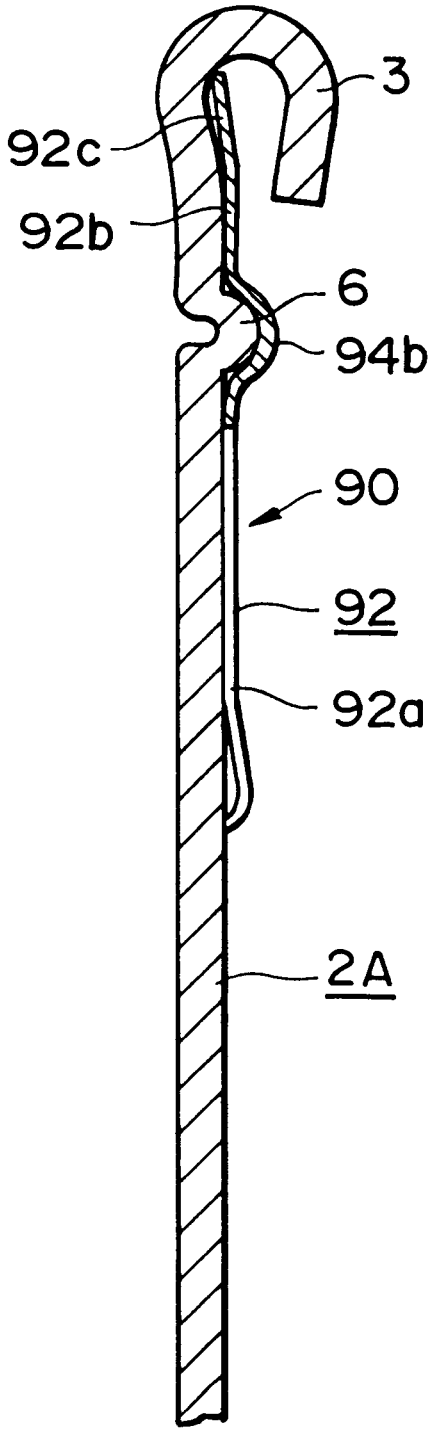
FIG. 25 shows further modification and is a sectional view corresponding to FIG. 19.

FIG. 25 illustrates further modification. The attaching finger 92 is formed to have a recess 94*b* into which the projection 6 is fitted, in place of the hole 94.

Fourth Embodiment

Figure 26:
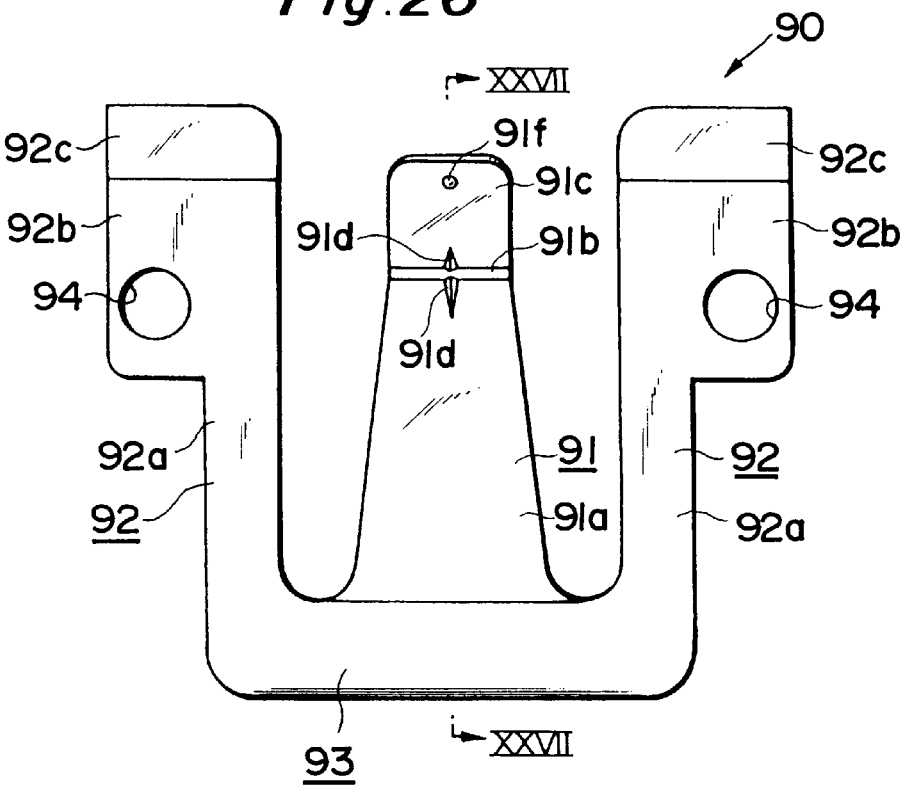
FIG. 26 is a front view of a wire clip according to a fourth embodiment.
Figure 27:
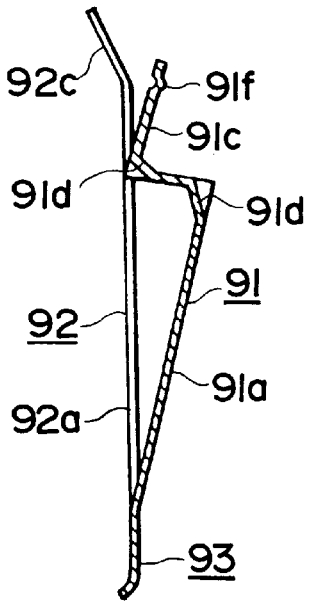
FIG. 27 is a sectional view taken along line XXVII—XXVII of FIG. 26.
Figure 28:
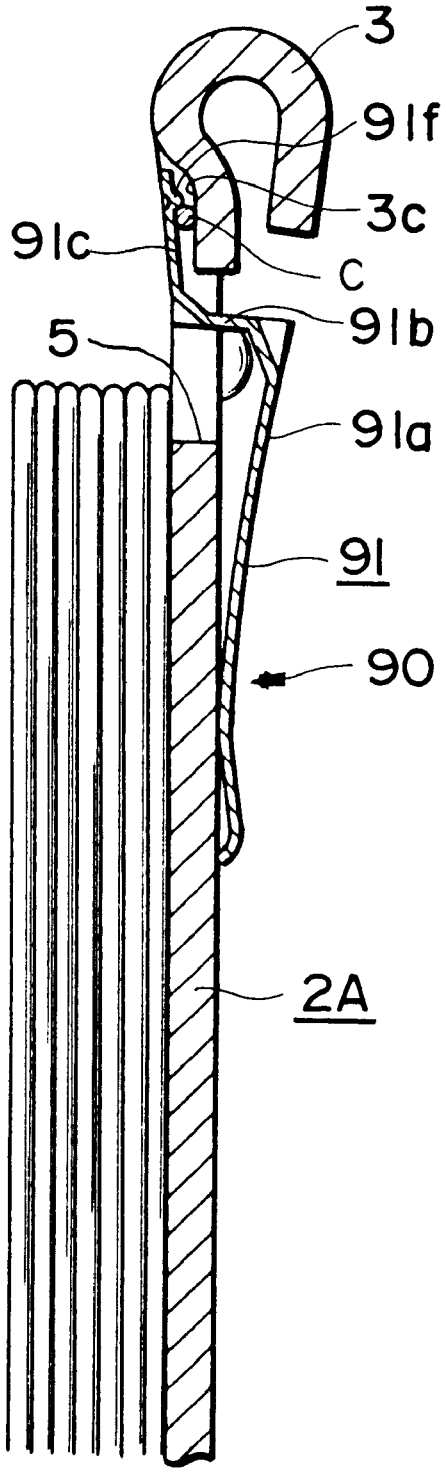
FIG. 28 is a sectional view showing the end of a cord in the secured state.

FIGS. 26 to 28 illustrate a fourth embodiment. The same members or portions as those in the third embodiment are assigned by the same reference numerals to dispense with the repeated description and the description is made on only different portions. The same is true of other embodiments which will be referred to later.

The retaining finger 91 is formed to have a small projection 91*f* at the distal end portion 91*c* thereof. The small projection 91*f* effectively prevents the end portion of the cord which is clamped between the distal end portion 91*c* of the retaining finger 91 and the inner surface of the flange 2A from slipping off.

The retaining finger 91 may be formed to have a recess for receiving the end portion of cord at the distal end portion 91*c* thereof.

Fifth Embodiment

Figure 29:
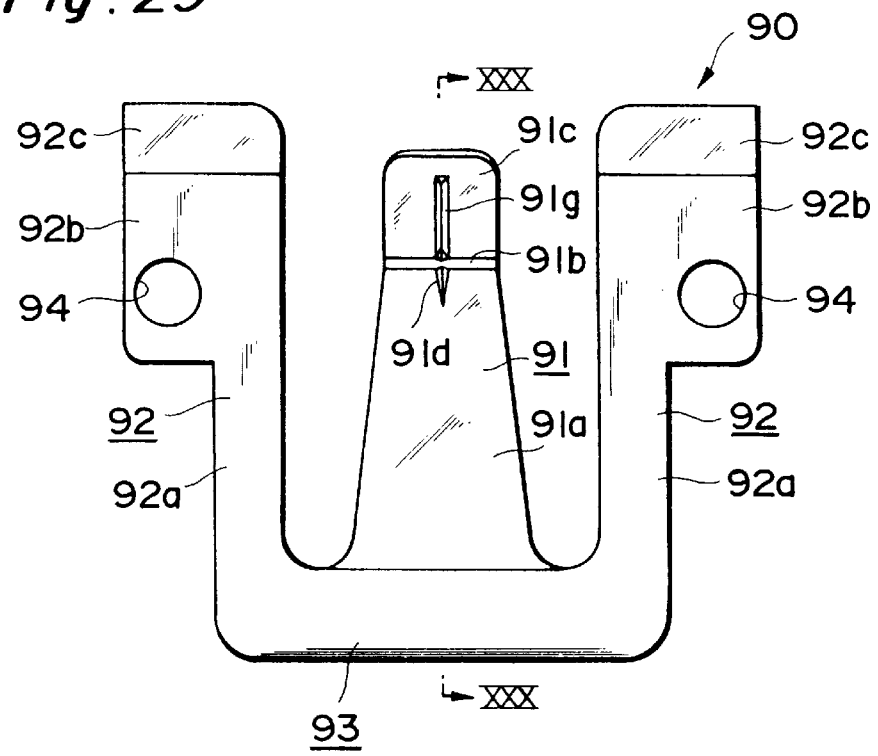
FIG. 29 is a front view of a wire clip according to a fifth embodiment.
Figure 30:
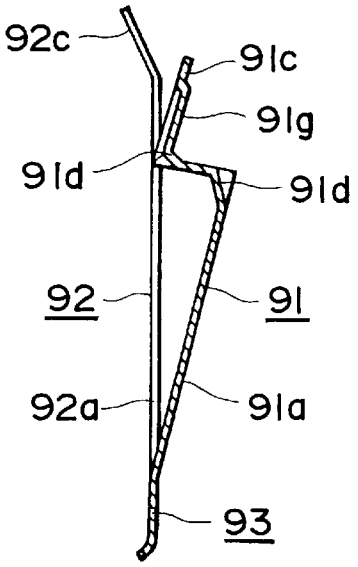
FIG. 30 is sectional view taken along line XXX—XXX of FIG. 29.
Figure 31:
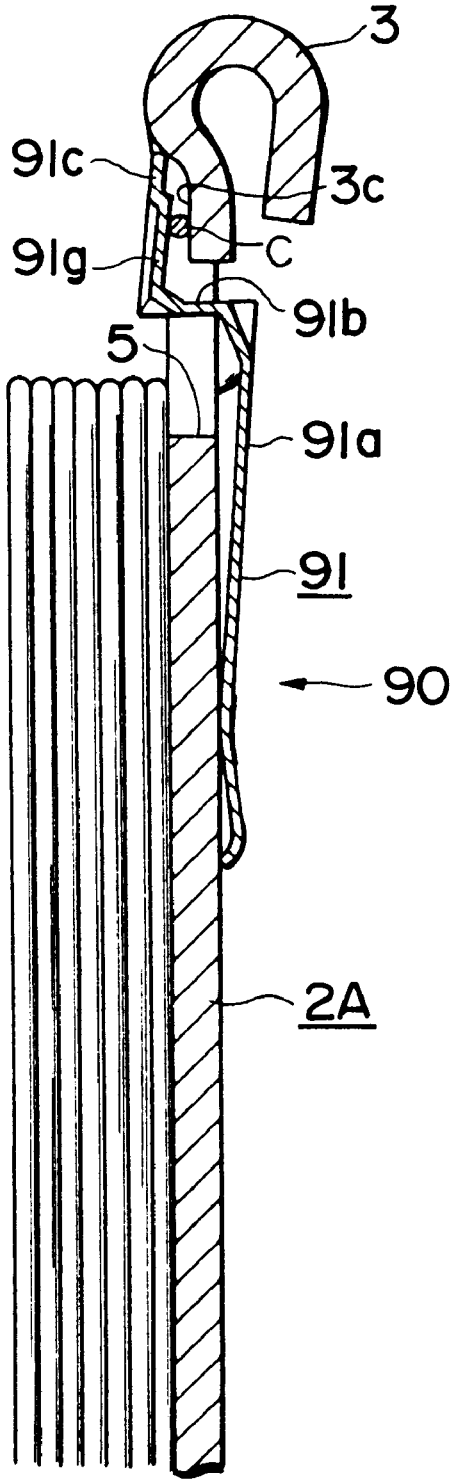
FIG. 31 is a sectional view showing the end of a cord in the secured state.
Figure 32:
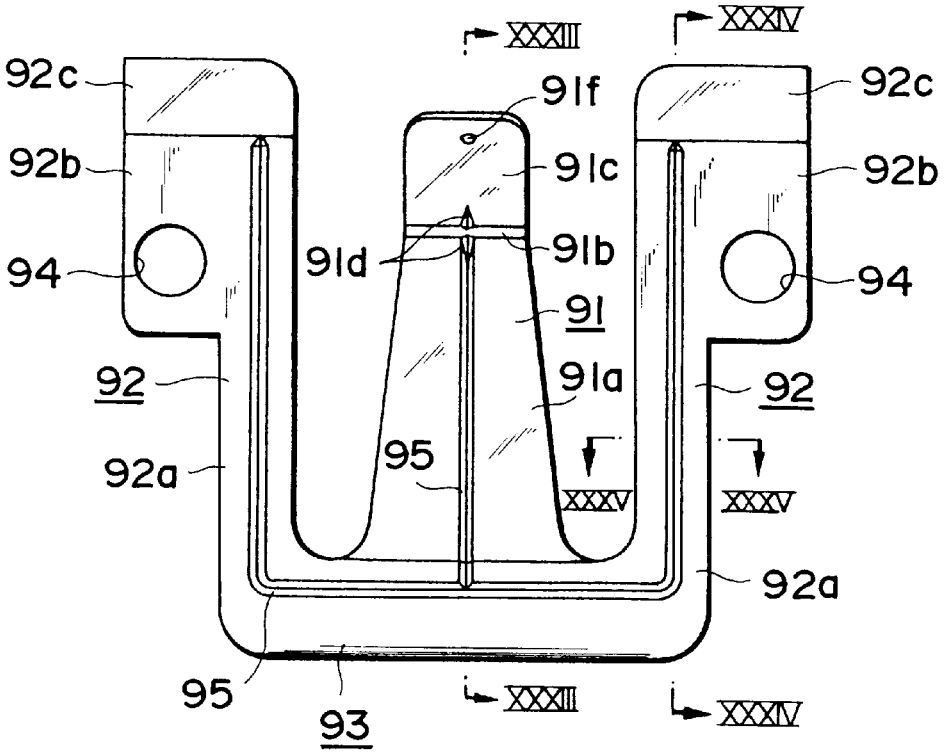
FIG. 32 is a front view of a wire clip according to a sixth embodiment.
Figure 33:
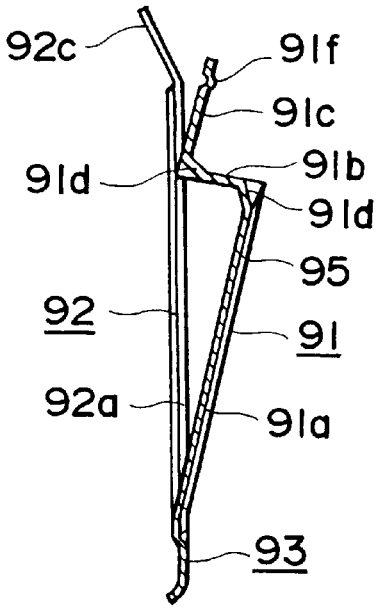
FIG. 33 is a sectional view taken along line XXXIII—XXXIII of FIG. 32.
Figure 34:
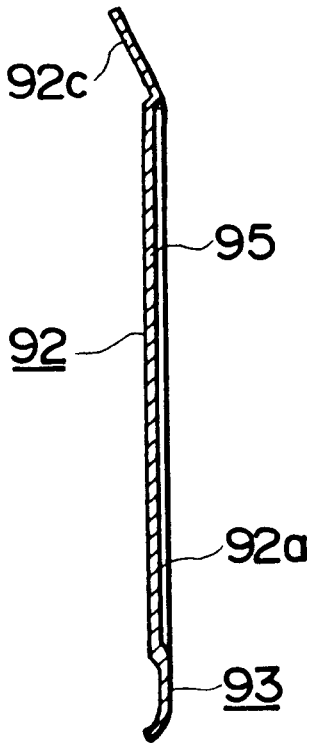
FIG. 34 is a sectional view taken along line XXXIV—XXXIV of FIG. 32.
Figure 35:
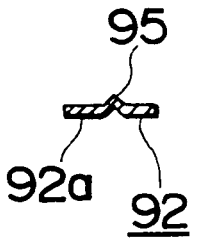
FIG. 35 is a sectional view taken along line XXXV—XXXV of FIG. 32.
Figure 36:
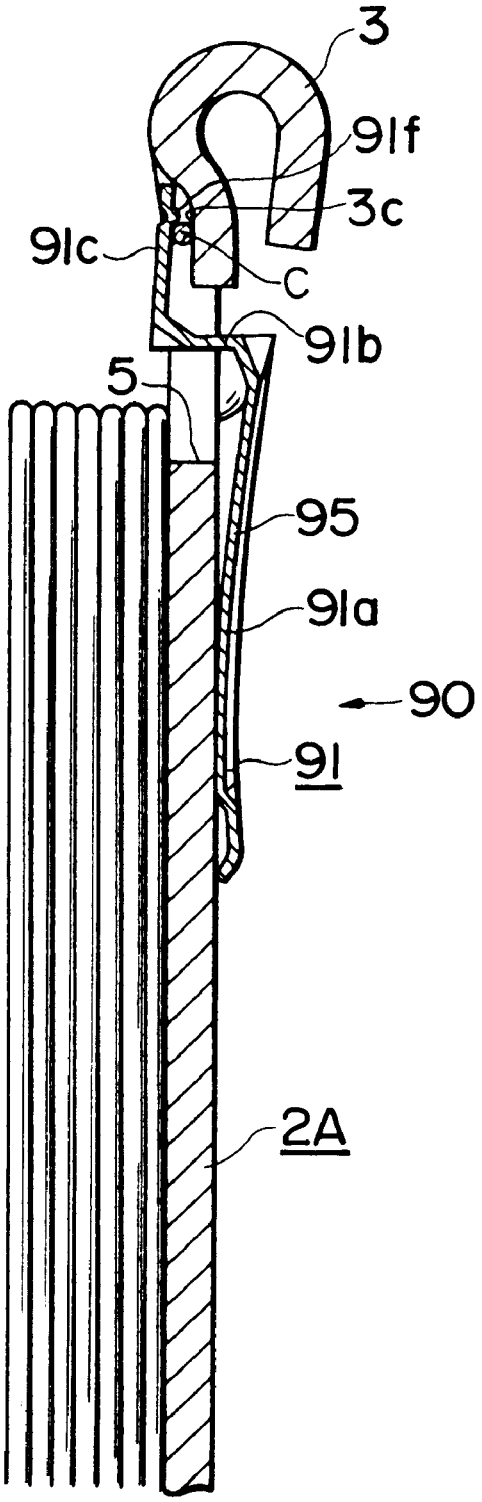
FIG. 36 is a sectional view showing the end of a cord in the secured state.
Figure 37:
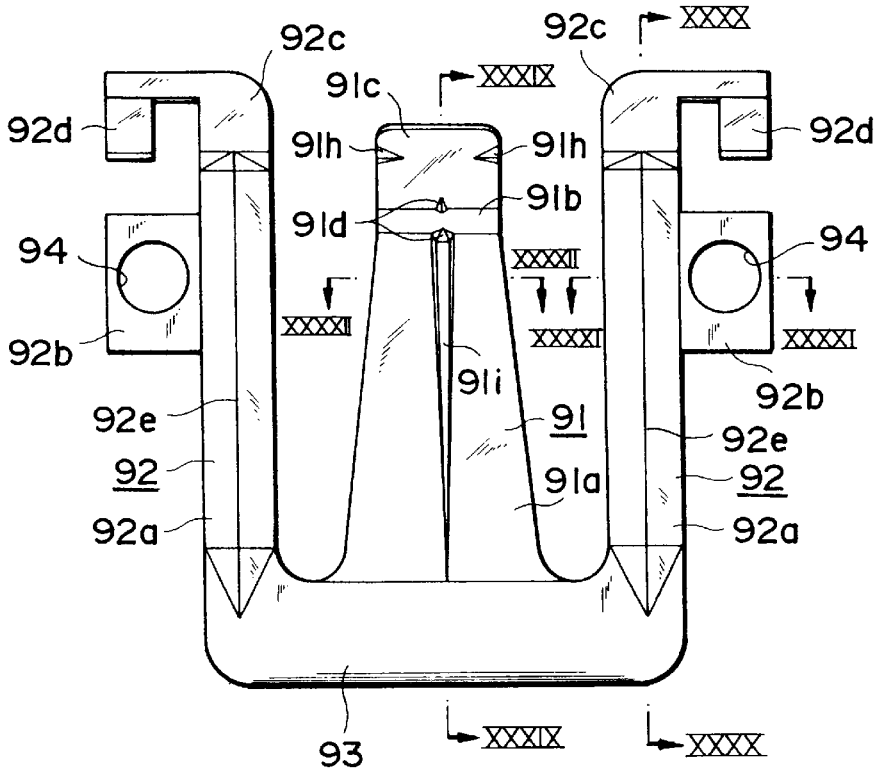
FIG. 37 is a front view showing a wire clip according to a seventh embodiment.
Figure 38:
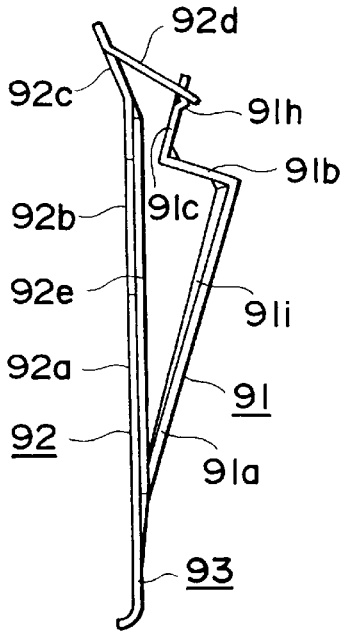
FIG. 38 is a side view of the wire clip according to the seventh embodiment.
Figure 39:
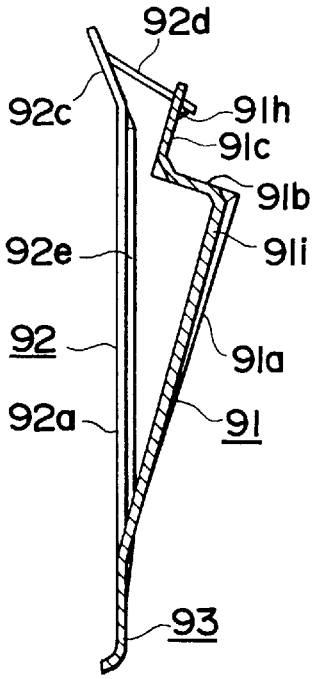
FIG. 39 is a sectional view taken along line XXXIX—XXXIX of FIG. 37.
Figure 40:
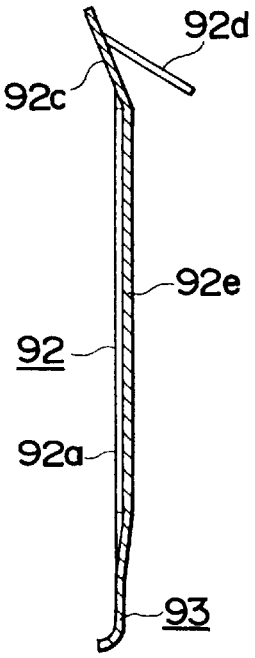
FIG. 40 is a sectional view taken along line XXXX—XXXX of FIG. 37.
Figure 41:
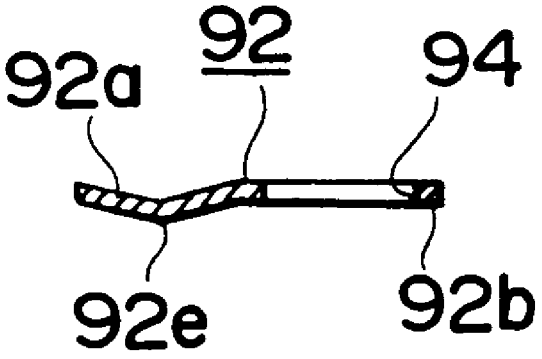
FIG. 41 is a sectional view taken along line XXXXI—XXXXI of FIG. 37.
Figure 42:
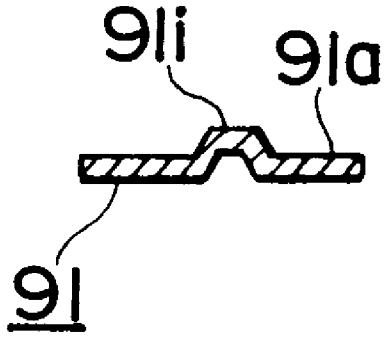
FIG. 42 is a sectional view taken along line XXXXII—XXXXII of FIG. 37.
Figure 43:
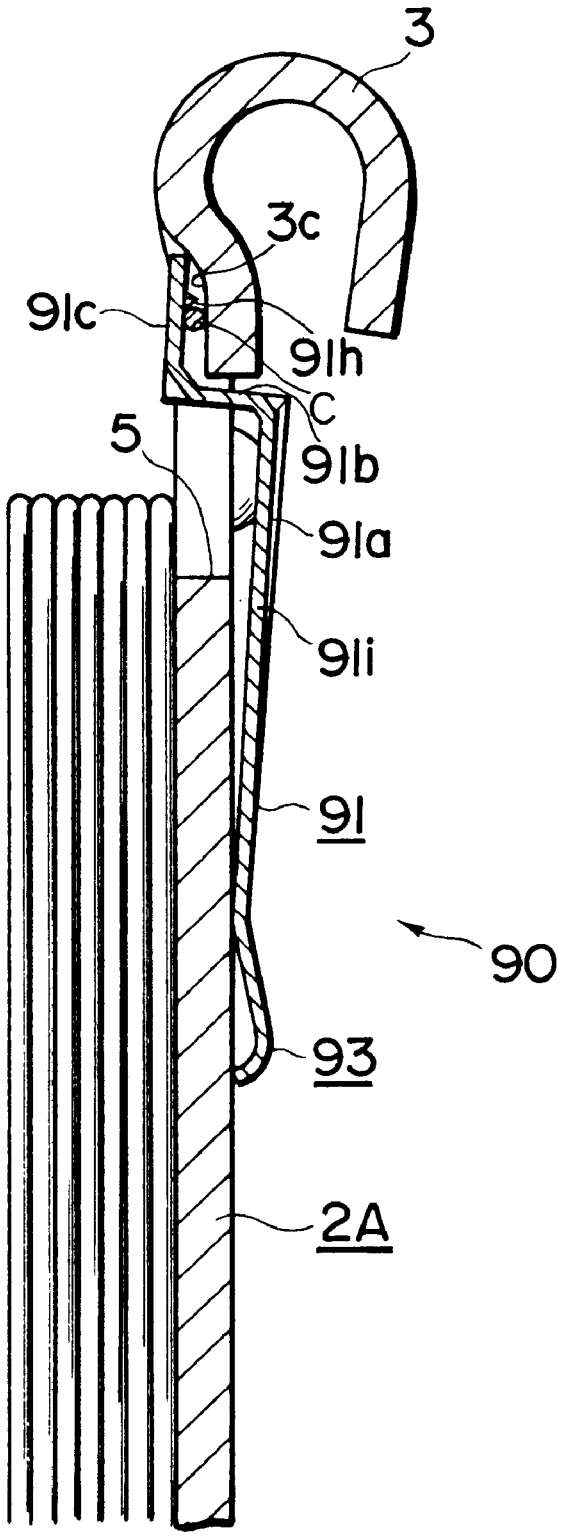
FIG. 43 is a sectional view showing the end of a cord in the secured state.

FIGS. 29 through 31 show a fifth embodiment. The retaining finger 91 is formed to have a rib 91*g* at the distal end portion 91*c* thereof and the distal end portion 91*c* is reinforced.

Sixth Embodiment

FIGS. 32 to 36 illustrate a sixth embodiment. A reinforcing rib 95 is formed on all over the portion 91*a* of the retaining finger 91, portions 92*a* and 92*b* of the attaching fingers 92 and the connecting piece 93.

Seventh Embodiment

FIGS. 37 through 43 illustrate a seventh embodiment.

The distal end portion 91*c* of the retaining finger 91 is formed to have ribs 11*h* at the both sides thereof for reinforcing and for preventing the cord end from slipping off. Further, the portion 91*a* of the retaining finger 91 is formed to have a reinforcing rib 91*i*.

The attaching fingers 92 are also formed to have reinforcing ribs 92*e* at the portions 92*a* and 92*b* thereof.

The attaching fingers 92 are further formed with engaging pieces 92*d* bent outward at parts of the distal end portions 92*c* thereof. The engaging pieces 92*d* are caught inside the folded-back portions 3 on the outer circumferentials of the flanges to more strongly secure the wire clips 90 to the flanges.

Eighth Embodiment

Figure 44:
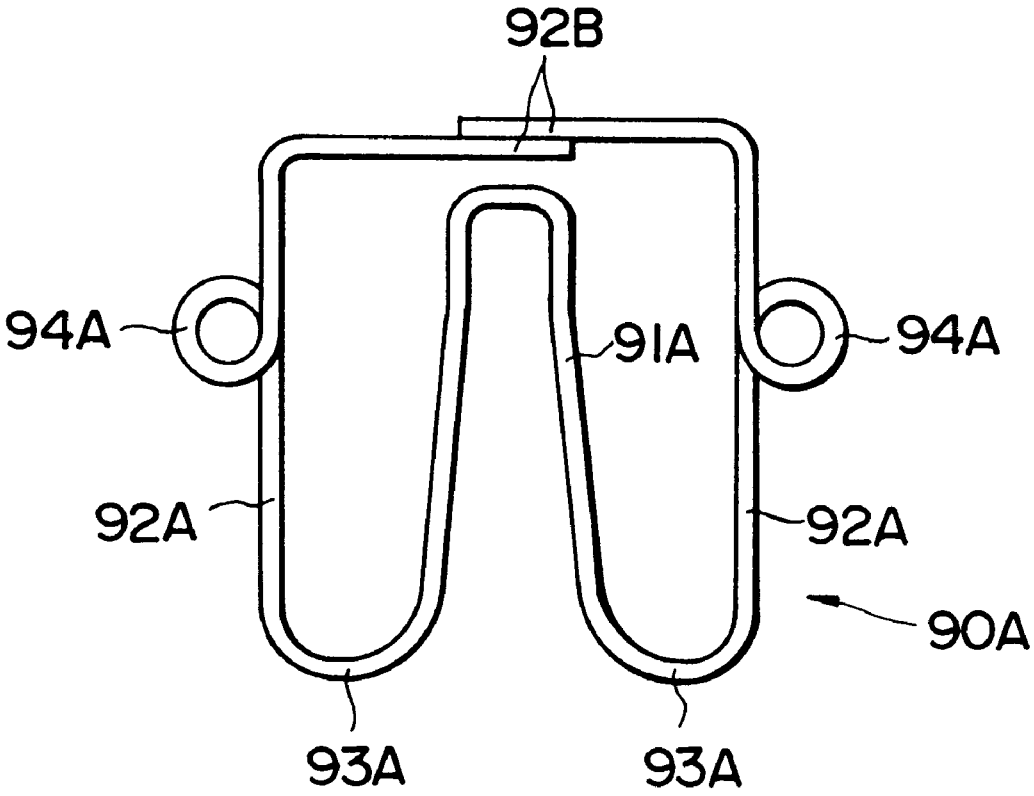
FIG. 44 is a front view showing a wire clip according to an eighth embodiment.

FIG. 44 illustrates a wire clip 90A made of a piece of steel wire. The piece of the wire is bent so as to form a portion 91A corresponding to the retaining finger which serves as a center, is further bent to form portions 93A corresponding to the connecting piece and portions 92A corresponding to the attaching fingers, is wound once so as to form holes, and is overlapped at both ends 92B thereof.

Ninth Embodiment

In the first through eighth embodiments, the structure of a reel for taking up a cord is described in detail. The reel is such that the end of a cord-like body is fastened easily and reliably and lends itself to automation of this process.

A ninth embodiment of the invention relates to an apparatus for automatically taking up a cord-like body, the apparatus having an automatic end fastening device suited to all the reels having the structures described above. The reel of the second embodiment is illustrated as the example of the reel used in this apparatus.

Figure 45:
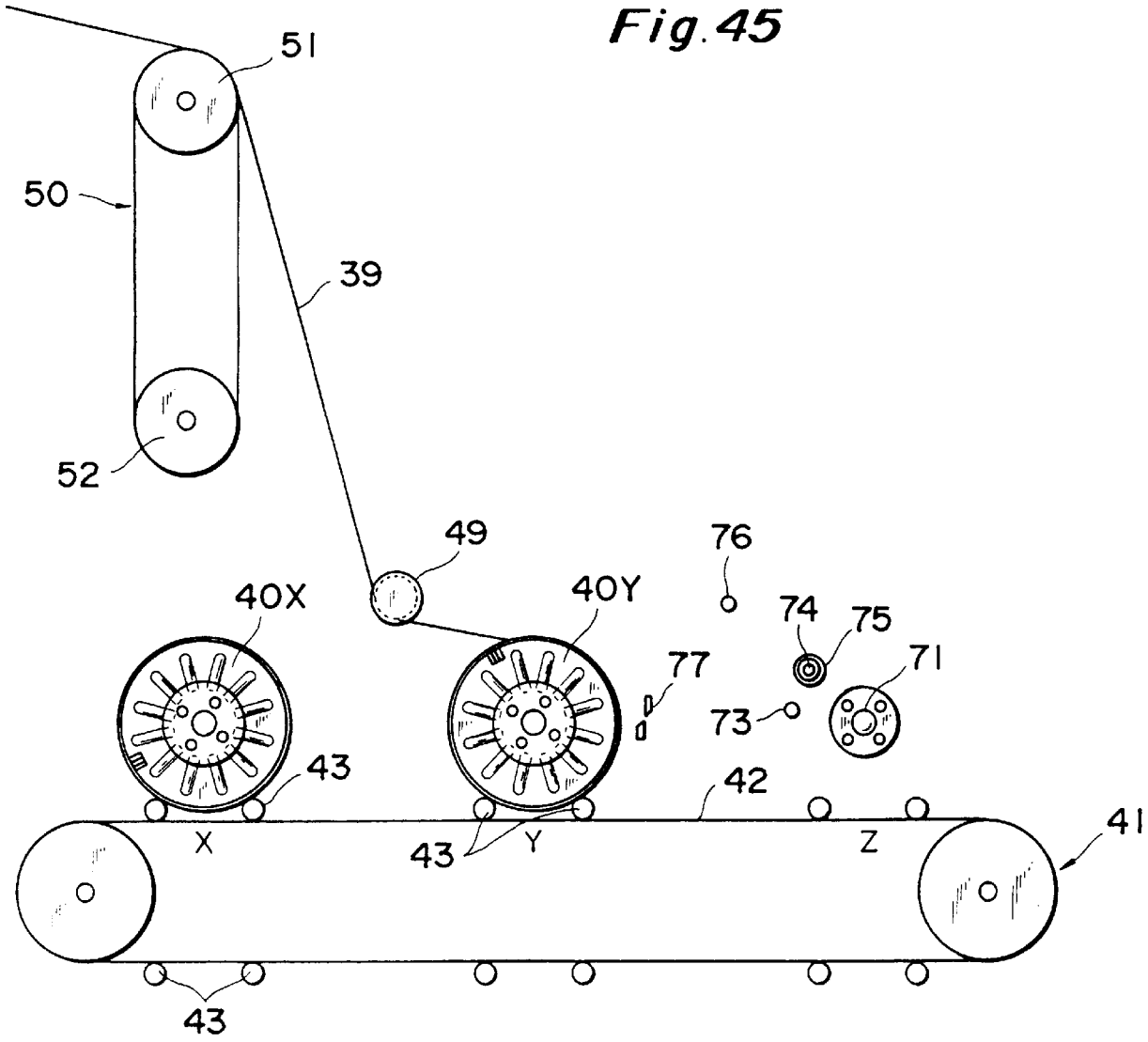
FIG. 45 is a side view illustrating an apparatus for automatically taking up a cord according to a ninth embodiment of the invention, this view showing the apparatus when take-up of a cord has ended.
Figure 46:
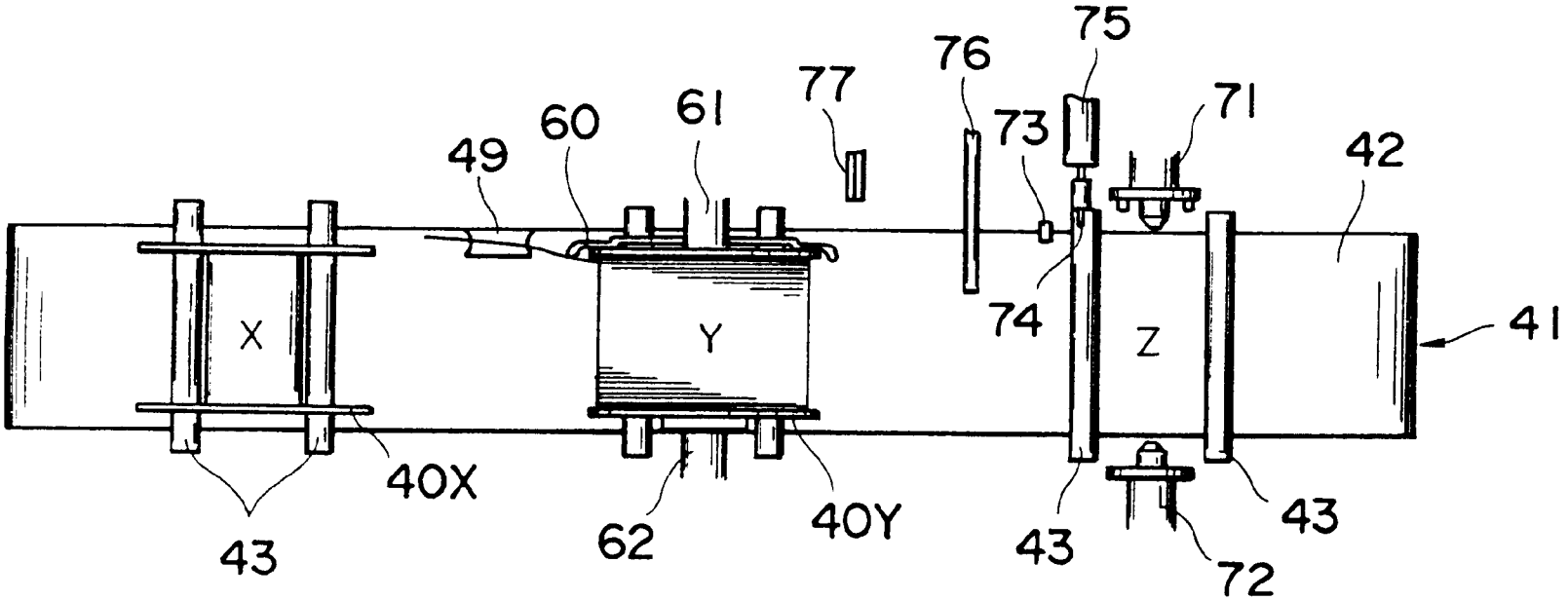
FIG. 46 is a plan view showing the apparatus for automatically taking up the cord and corresponding to FIG. 45.
Figure 47:
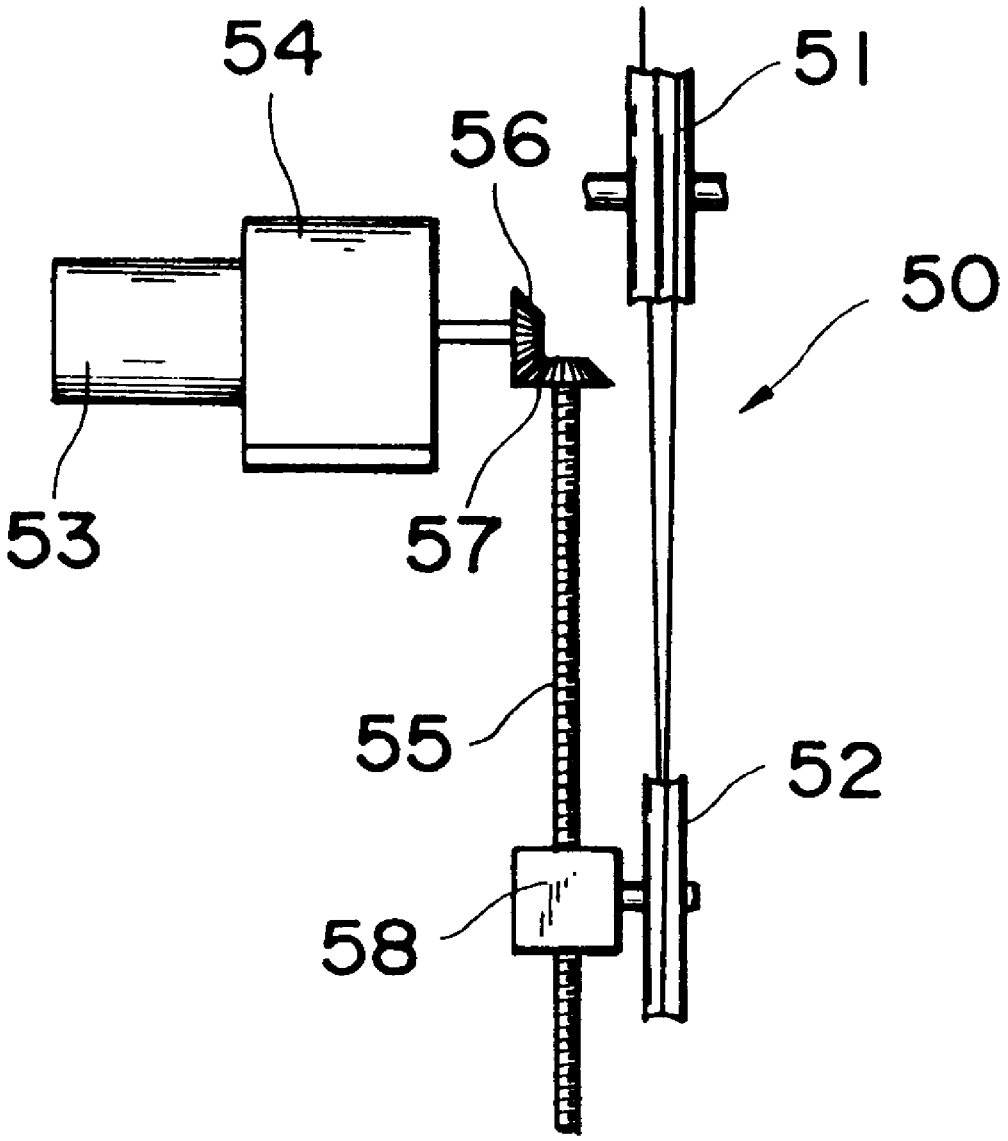
FIG. 47 illustrates the construction of a cord adjusting device.

FIGS. 45 through 47 illustrate a state in which a cord is being taken up on a first reel or in which take-up of the cord on the first reel has just ended in an apparatus for automatically taking up the cord.

The automatic take-up apparatus is equipped with a reel transfer mechanism 41. The latter includes a driven belt or chain 42 on which a reel holding device is provided. The reel holding device is composed of two spaced rolls 43 disposed in parallel to each other in a freely rotatable manner. A reel is placed upon the rolls 43.

The reel transfer mechanism 41 is provided with an empty reel standby position X, a cord take-up position Y and a cord-end fastening position (clamping position) Z. The reel is successively transferred from position X to position Y and then from position Y to position Z. The reel is designated generally by numeral 40. However, in a case where it is necessary to specifically point out the reel at each of the positions X, Y and Z, the reel will be represented by 40X, 40Y and 40Z, respectively.

A cord 39 is unwound from a large reel (not shown) or is supplied to the automatic take-up apparatus from a cord manufacturing apparatus (not shown), and the cord is fed to the reel 40Y, which is being held at the take-up position Y, via a cord adjusting device 50 and traverse roll 49. The adjusting device 50 has two rolls, namely a fixed roll 51 and a moving roll 52, with which the cord 39 is engaged. The adjusting device 50 accumulates the cord between the rolls 51 and 52 and tensions the cord 39 constantly when the cord is taken up on the reel. When the reel is transferred to the clamping position, the adjusting device 50 smoothly supplies the cord that has been accumulated in the operation for fastening the end of the cord.

The fixed roll 51 of the adjusting device 50 is provided on a shaft freely rotatably supported on a frame (not shown). The moving roll (dancer roll) 52 is freely rotatably supported on a shaft provided on a moving body 58. The moving body 58 is movably guided in the vertical direction by a guide (not shown) and is provided with a ball screw support. A ball screw 55 is supported so as to be freely rotatable in the vertical direction and is in meshing engagement with the ball screw support of the moving body 58.

The adjusting device 50 includes a motor 53 having a speed-reduction mechanism, and a clutch/brake unit 54. A bevel gear 56 provided on an output shaft of the unit 54 and a bevel gear 57 attached to the upper end of the ball screw 55 are in meshing engagement. Accordingly, the driving power of the motor 53 is transmitted to the ball screw 55 via the clutch/brake unit 54 and bevel gears 56, 57, thereby rotating the ball screw 55 which, in turn, moves the moving roll 52 up and down. The movement of the moving roll 52 is controlled in dependence upon the clutch operation and brake operation of the clutch/brake unit 54 in a manner described later.

The cord 39 supplied to the reel 40Y is engaged with a traverse roll 49 between the adjusting device 50 and the reel 40Y. The traverse roll 49 is supported so as to be freely movable along the axis of the reel 40Y (the direction perpendicular to the transfer direction of the transfer mechanism 41) and freely rotatable. When the cord 39 is taken up on the reel 40Y, the traverse roll 49 is moved back and forth from one end of the reel 40Y to the other (i.e., between the two flanges 2A and 2B) along the axial direction of the reel in sync with the rotation thereof, whereby the cord is formed into a line while it is taken up on the reel.

Figure 48:
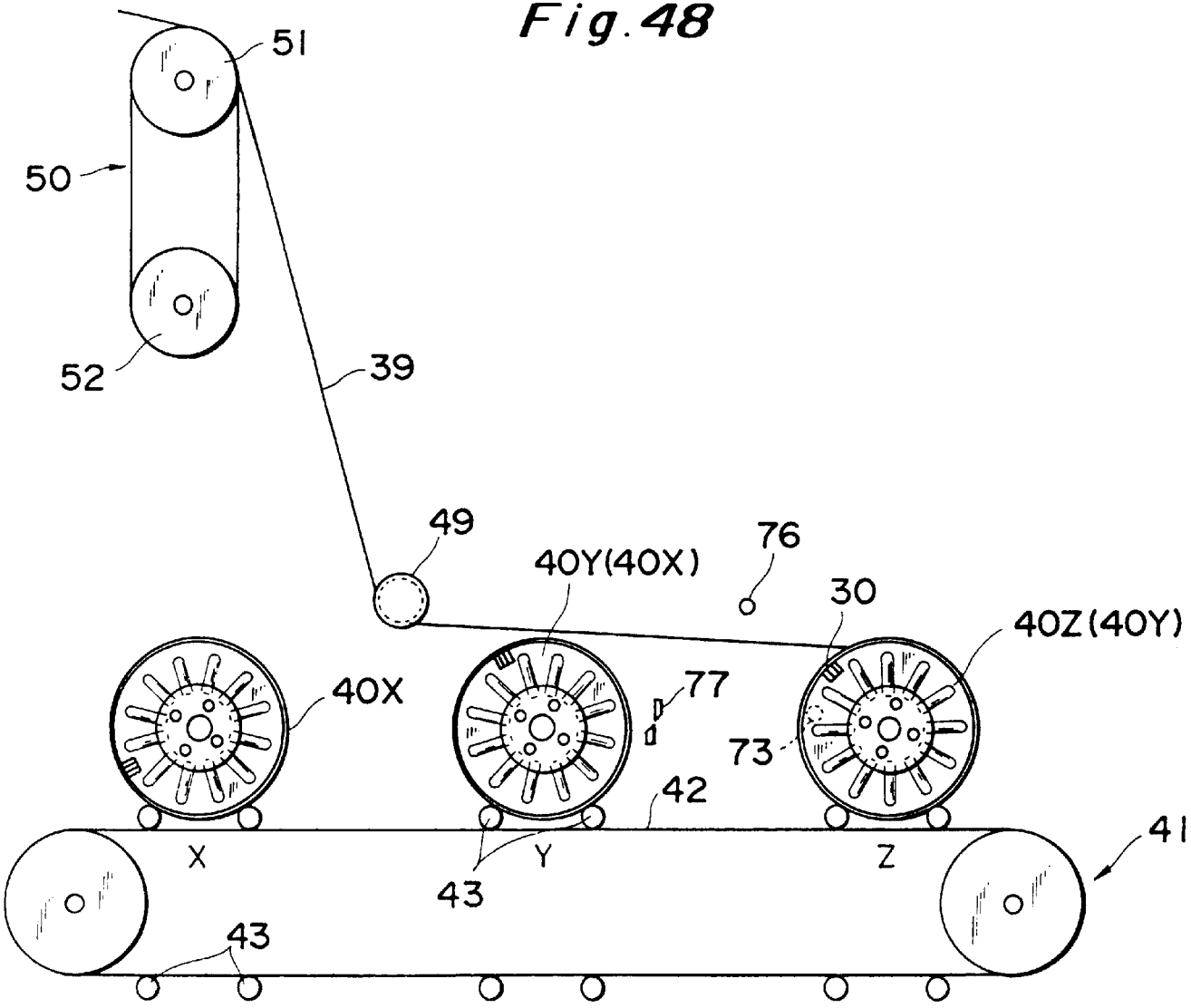
FIG. 48 is a side view showing the apparatus for automatically taking up the cord, this view illustrating the apparatus when fastening of the cord starts.
Figure 49:
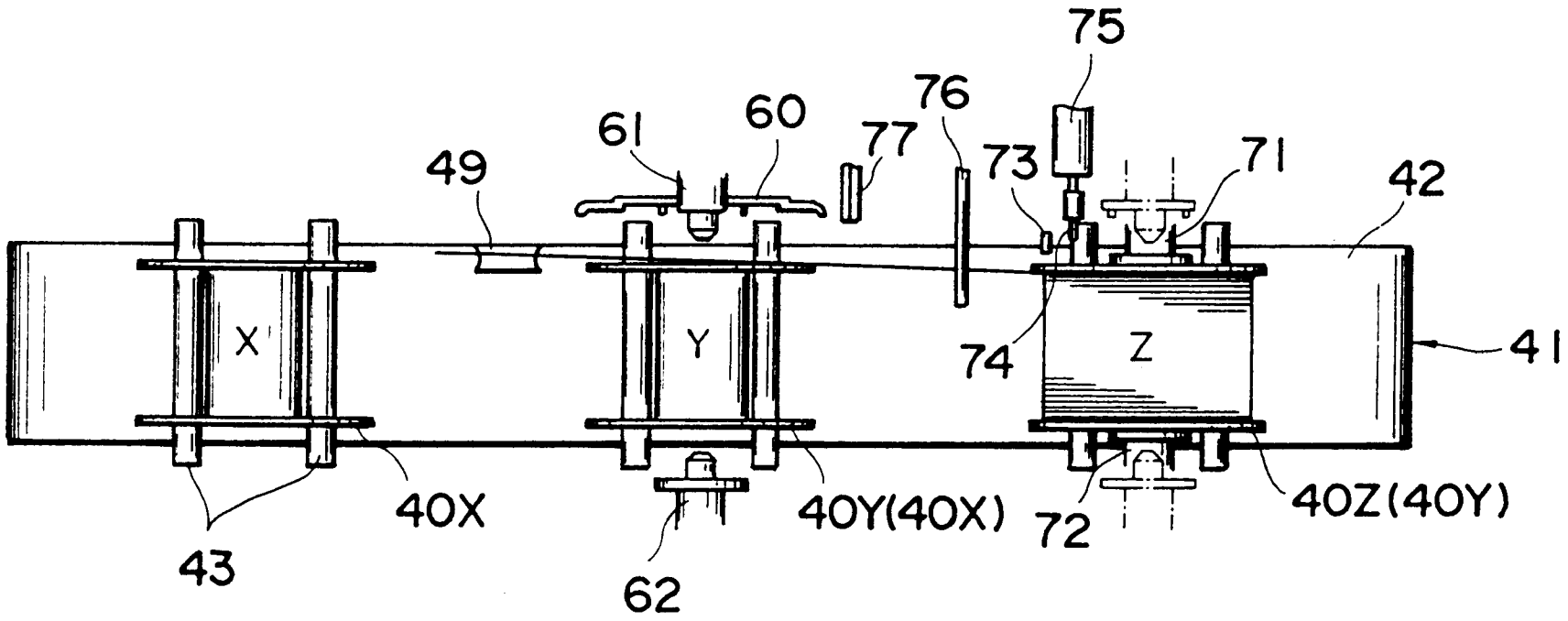
FIG. 49 is a plan view showing the apparatus for automatically taking up the cord and corresponding to FIG. 48.

As shown also in FIGS. 48 and 49, a spindle (the driving side) 61 and a tail stock (the driven side) 62 are provided on respective sides of the transfer mechanism 41 at the take-up position Y so as to be free to move toward and away from the reel 40Y.

The spindle 61 is provided with a flange 60 for restraining the tip of the cord between itself and the flange 2A of the reel. (As will be described later, the flange 60 is used when the cord starts to be taken up on the reel.) The spindle 61 is further provided with a center, which is inserted into the central hole of the inner cylinder 1B of the reel, and pins inserted into the holes 1D of the reel. The spindle 61 is driven by a motor (not shown).

The tail stock 62 is equipped with a center, which is inserted into the central hole of the inner cylinder 1B of the reel, and it supported so as to rotate freely.

A spindle 71 and a tail stock 72 are provided on respective sides of the transfer mechanism at the clamping position Z so as to be free to move toward and away from each other. The spindle 71 is provided with a center, which is inserted into the central hole of the inner cylinder 1B of the reel, and pins inserted into the holes 1D of the reel. The spindle 71 is driven by a servomotor (not shown). The tail stock 72 is equipped with a center, which is inserted into the central hole of the inner cylinder 1B of the reel, and is supported so as to rotate freely.

Figure 50:
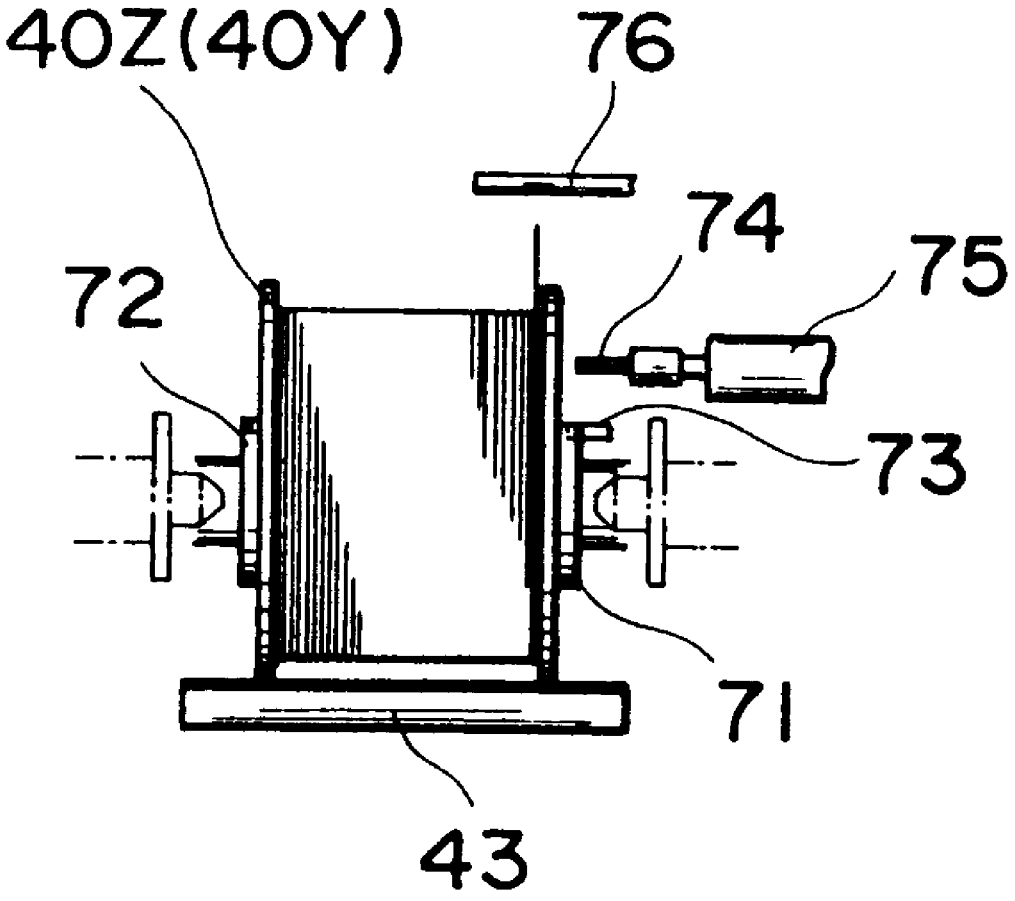
FIG. 50 is a front view showing an end fastening position in the apparatus for automatically taking up the cord.

As shown also in FIG. 50, a sensor 73 for sensing the cord retainer 30 and a pusher 74 are provided at the clamping position Z on the driven side (or on the side faced by the flange 2A with which the cord retainer 30 of the reel is provided). The sensor 73 and pusher 74 are both placed at positions confronting the path traversed by the cord retainer 30 when the reel 40Z at the clamping position Z is rotated.

The sensor 73 is a reflection-type photoelectric sensor, by way of example, for detecting the cord retainer 30 based upon a change in reflected light from the retainer. When light emitted by the sensor 73 is projected upon a location near the outer circumference of the reel flange 2A where the reinforcing ribs 4 are not provided, the intensity of the reflected light is substantially constant. The window 6 is present at the portion of the flange 2A where the cord retainer 30 is provided. Further, the retaining finger 31 of the cord retainer 30 is curved. Since the reflected light diminishes at this location, the cord retainer 30 is sensed.

An arrangement may be adopted in which what is sensed by the sensor 73 is not the cord retainer 30 itself but reflector or mark provided near the cord retainer 30. Further, the sensor 73 is not limited to reflection-type photoelectric sensor.

The pusher 74 pushes the retaining finger 31 of the cord retainer 30 and is driven by an air cylinder 75. The distal end face of the pusher 74 preferably is formed to have a curved shape that matches the curved shape of the retaining finger 31 or is provided with a resilient body such as piece of rubber. The pusher 74 is situated ahead of the sensor 73 with respect to the direction of rotation of the reel 40Z.

A cord pushing member 76 and a cutter 77 are provided between the clamping position Z and take-up position Y. The cord pushing member 76 is located somewhat above the reel on the transfer mechanism 41 at all times and is driven by a drive unit (not shown) so as to be moved downward when the end of the cord is fastened. The cutter 77 is for cutting the cord. The cutter 77 is usually held at a position offset to the side of the reel transfer path of the transfer mechanism 41.

When the cord is taken up by the reel 40Y at the take-up position Y, as shown in FIGS. 45 through 47, the spindle 61 and tail stock 62 are advanced and inserted into the center holes of the inner cylinder 1B of the reel to thereby hold the reel. Rotatively driving the spindle 61 also rotates the reel, which proceeds to take up the cord. At this time the moving roll 52 of the adjusting device 50 is at its lower-limit position. Since the clutch and brake of the clutch/brake unit 54 are held in the off and on states, respectively, the moving roll 52 is maintained at its lower-limited position.

When the cord taken up on the reel fills the reel (or when a predetermined length of the cord is taken up on the reel) and the take-up operation is ended, the traverse roll 49 stops at a predetermined position (the position on the side of spindle 61, as shown in FIG. 46 or FIG. 49). The portion of the cord extending from the reel toward the traverse roll 49 lies along the inner surface of the flange 2A of the reel.

The spindle 61 and tail stock 62 are withdrawn and separated from the reel 40Y. The transfer mechanism 41 is driven so that the reel 40Y is transferred to the clamping position Z. [The reel is indicated at 40Z (40Y).]

The clutch and brake of the clutch/brake unit 54 of adjusting device 50 are both turned off. As a result, the cord is pulled as the reel is transferred, and the ball screw 55 is rotated by the force produced, thereby raising the moving roll 52. The spindle 71 and tail stock 72 are at their withdrawn positions. An empty reel 40X, which was located at the standby position X, is transferred to the take-up position Y [this reel is indicated at 40Y (40X)], and a new empty reel 40X is brought to the standby position X. This is the state illustrated in FIGS. 48, 49 and 50.

The spindle 71 and tail stock 72 are advanced to clamp the reel 40Z (40Y), and the spindle 71 is rotatively driven in a direction to take up the cord. The cord retainer 30 is sensed by the sensor 73 by the time the reel makes one full revolution at most. The clutch and brake of the clutch/brake unit 54 of adjusting device 50 are both held in the off state. As a result, the cord is tensioned as the reel rotates and the moving reel 52 is raised further.

The positional relationship between the sensor 73 and pusher 74 is predetermined. The reel 40Z (40Y) is rotated further through a predetermined angle from the angular position at which the cord retainer 30 was sensed by the sensor 73, and the cord retainer 30 is brought to a position opposing the pusher 74. During this time the moving roll 52 rises a distance conforming to the angle of rotation of the reel.

Figure 52:
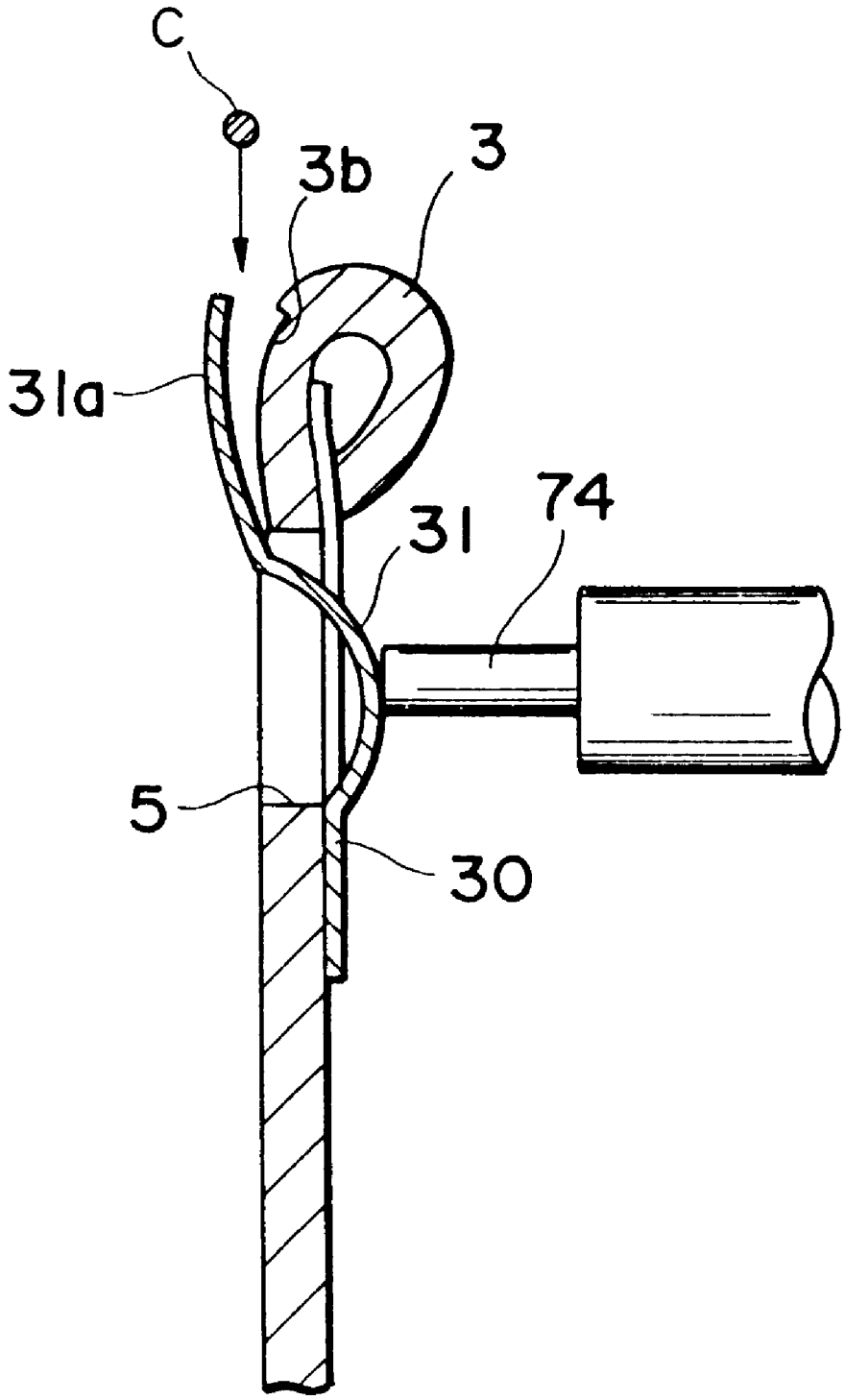
FIG. 52 is a sectional view showing a state in which a retaining finger of the cord retainer is being pushed by a pusher.

An any cylinder 75 is driven so that the pusher 74 pushes the retaining finger 31 of the cord retainer 30 into the reel, as illustrated in FIG. 52. As a result, the distal end 31*a* of the raining finger 31 separates from the inner side surface of the flange 2A on the outer circumference thereof to form a gap between itself and the inner circumferential surface of the flange 2A.

Figure 51:
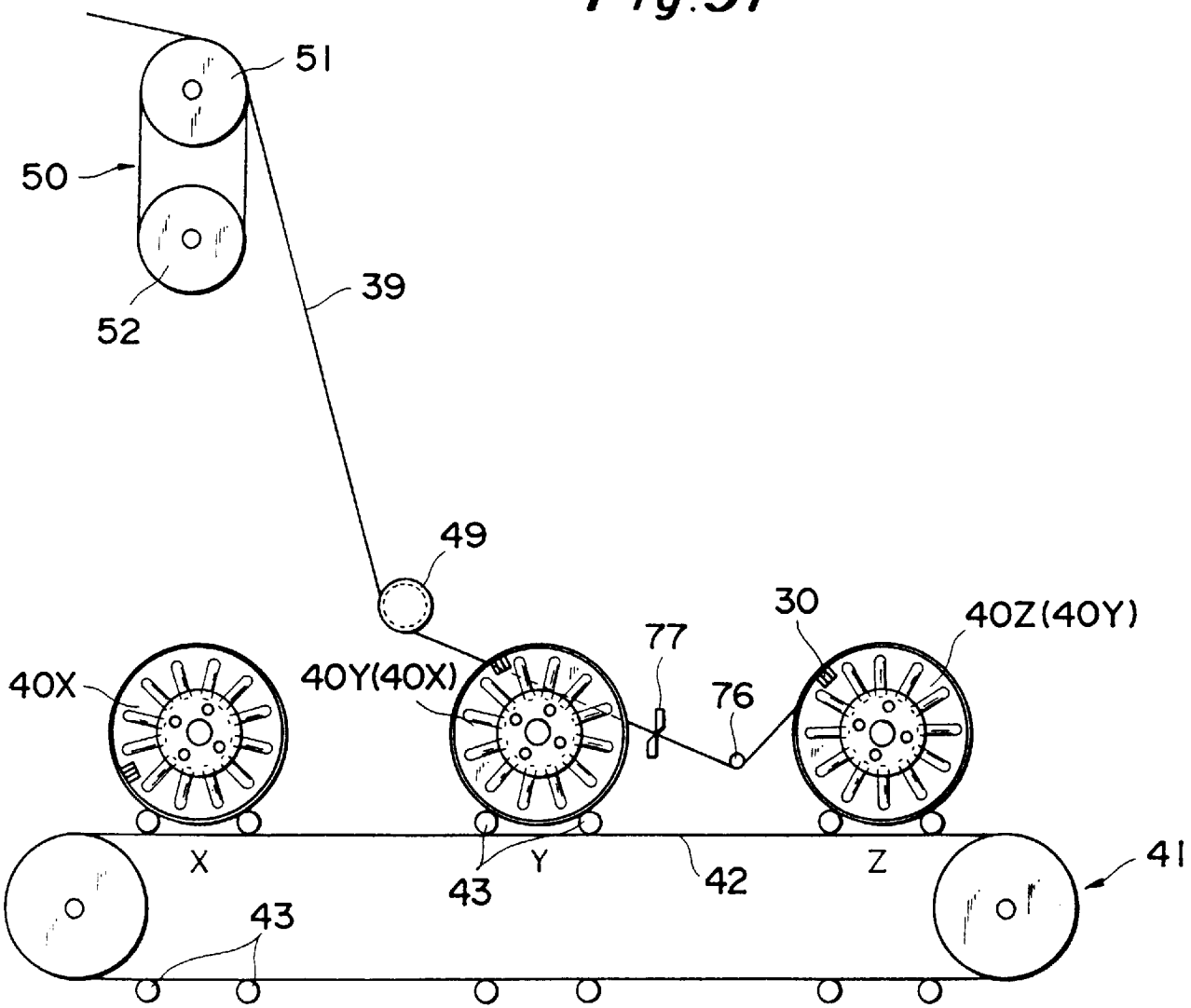
FIG. 51 is a side view showing the apparatus for automatically taking up the cord, this view illustrating the apparatus when it is the process of fastening the end of the cord.

Next, the cord pushing member 76 is lowered to push the cord downward between the take-up position Y and the clamping position Z. Since the portion of the cord extending from the reel 40Z (40Y) to the traverse roll 49 lies along the inner surface of the flange 2A, this portion (end portion C) of the cord is inserted into the gap between the distal end 31*a* of retaining finger 31 and the inner side surface of the flange 2A at the outer circumference thereof. The moving roll 52 is raised further at this time. Thereafter, the air cylinder 75 is withdrawn to return the pusher 74, as a result of which the retaining finger 31 returns to its original state owing to its resilience. The cord 39 is clamped and secured between the distal end 31*a* of the retaining finger 31 and the inner side surface of the flange 2A at the circumference thereof. This is the state illustrated in FIG. 51.

The traverse roll 49 is at rest at a position outwardly of the flange 2A of the reel. When the empty reel 40Y (40X) is advanced to the take-up position Y, therefore, the cord comes to occupy a position outwardly of the flange 2A of the reel (see FIG. 49).

The spindle 61 and the tail stock 62 are both advanced to hold the reel 40Y (40X) at the take-up position. The flange 60 of the spindle 61 covers the flange 2A of the reel 40Y (40X) from the outside to clamp the cord located between the flange 60 and the flange 2A. The cutter 77 is advanced to cut the cord at a position between the cord pushing member 76 and the reel 40Y (40X) at the take-up position Y.

The reel 40Z (40X) that has taken up the cord and fastened the cord end C by the cord retainer 30 is transferred to the next process, e.g., a crating process or line-up process.

The brake is turned off, the clutch is turned on and the motor 53 is driven in the adjusting device 50, whereby the ball screw 55 is rotated to lower the moving roll 52 to its lower-limit position. This is followed by turning off the clutch and turning on the brake.

The spindle 61 starts being rotated to rotate the reel 40Y (40X) at the take-up position Y, whereby the cord is taken up on the reel. The traverse roll 49 also is moved back and forth along the axial direction of the reel in sync with the rotation of the reel.

This end portion of the cord clamped between the flanges 2A, 60 and protruding from between them is cut manually in the crating process of line-up process that follows the fastening of the cord end.

As many apparently widely different embodiments of the present invention can be made without departing from the spirit and scope thereof, it is to be understood that the invention is not limited to the specific embodiments thereof except as defined in the appended claims.

What is claimed is:

1. A reel for taking up a cord-like body, comprising:

a winding drum;

flanges provided on both ends of said winding drum, at least one of said flanges being provided with a window at a location adjacent to an outer circumferential portion thereof; and a cord retainer comprising a resilient body, said cord retainer being received within said window and including:

a central retaining finger having a distal end portion;

a pair of fixing fingers, one provided on either side of said central retaining finger and each having a distal end portion; and a connecting piece interconnecting said retaining finger and said fixing fingers;

the distal ends of said fixing fingers and said connecting piece being abutted against upper and lower edges, respectively, of the window from outside said at least one flange, the distal end potions of said fixing fingers being crimped and secured by a folded portion on the outer circumference of said at least one flange, and the distal end portion of said central retaining finger lying on an inner side surface of said at least one flange on the outer circumferential portion thereof;

the cord-like body being clamped and secured between the distal end portion of said retaining finger and the inner side surface of said at least one flange at the outer circumferential portion thereof.

2. The reel according to claim 1, wherein a recess for receiving the distal end portion of said retaining finger is formed on the inner side surface of said at least one flange on the outer circumferential portion thereof along which the distal end portion of said retaining finger lies.

3. The reel according to claim 1, wherein a recess for receiving at least a part of the cord-like body is formed in the distal end portion of said retaining finger.

4. The reel according to claim 1, wherein the outer circumferential edge portion of said at least one flange is formed to have a cord-end retaining portion at a position spaced away from said cord retainer along the outer circumference of said at least one flange in a direction in which the cord-like body is taken up.

5. The reel according to claim 1, wherein said cord retainer and said cord-end retaining portion are provided on both of said flanges.

6. The reel according to claim 1, wherein said cord retainer is formed from carbon tool steel and has a Rockwell hardness HRc of no less than 27.

7. The reel according to claim 6, wherein said cord retainer is formed from carbon tool steel and has a Rockwell hardness HRc of no less than 30.

8. The reel according to claim 6, wherein said cord retainer is subjected to quenching and annealing heat treatments.

9. A reel for taking up a cord-like body comprising:

a winding drum;

flanges provided on both ends of said winding drum, at least one of said flanges being provided with a window at a location adjacent to an outer circumferential portion thereof; and a cord retainer comprising a resilient body, said cord retainer being attached within said window and including:

a central retaining finger having a distal end portion;

a pair of fixing fingers, one provided on either side of said central retaining finger and each having a distal end portion; and a connecting piece interconnecting said retaining finger and said fixing fingers;

said fixing fingers and said connecting piece lying on an outer surface of said at least one flange at the sides of the window, the distal end portions of said fixing fingers being crimped and secured by a folded portion on the outer circumference of said at least one flange, said central retaining finger being curved at a central portion thereof so as to project outwardly of said at least one flange from said window with said distal end portion thereof being passed through said window so as to lie on an inner side surface of said at least one flange on the outer circumferential portion thereof;

the cord-like body being clamped and secured between the distal end portion of said retaining finger and the inner side surface of said at least one flange at the outer circumferential portion thereof.

10. The reel according to claim 9, wherein a recess for receiving the distal end portion of said retaining finger is formed on the inner side surface of said at least one flange on the outer circumferential portion thereof along which the distal end portion of said retaining finger lies.

11. The reel according to claim 9, wherein a recess for receiving at least a part of the cord-like body is formed in the distal end portion of said retaining finger.

12. The reel according to claim 9, wherein the outer circumferential edge portion of said at least one flange is formed to have a cord-end retaining portion at a position spaced away from said cord retainer along the outer circumference of said at least one flange in a direction in which the cord-like body is taken up.

13. The reel according to claim 9, wherein said cord retainer and said cord-end retaining portion are provided on both of said flanges.

14. The reel according to claim 9, wherein said cord retainer is formed from carbon tool steel and has a Rockwell hardness HRc of no less than 27.

15. The reel according to claim 14, wherein said cord retainer is formed from carbon tool steel and has a Rockwell hardness HRc of no less than 30.

16. The reel according to claim 14, wherein said cord retainer is subjected to quenching and annealing heat treatments.

17. A reel for taking up a cord-like body, comprising:

a winding drum;

flanges provided on both ends of said winding drum, at least one of said flanges being provided with a window at a location adjacent to an outer circumferential portion thereof; and a cord retainer comprising a resilient body, said cord retainer being received within said window and including:

a central retaining finger having a distal end portion;

a pair of fixing fingers, one provided on either side of said central retaining finger and each having a distal end portion; and a connecting piece interconnecting said retaining finger and said fixing fingers;

the distal end portions of said fixing fingers being crimped and secured by a folded portion on the outer circumference of said at least one flange, and the distal end portion of said central retaining finger lying on an inner side surface of said at least one flange on the outer circumferential portion thereof:

the cord-like body being clamped and secured between the distal end portion of said retaining finger and the inner side surface of said at least one flange at the outer circumferential portion thereof.

18. A reel for taking up a cord-like body, comprising:

a winding drum;

flanges provided on both ends of said winding drum;

a cord retainer comprising a resilient body, said cord retainer being attached to at least one of said flanges, and including:

a central retaining finger having a distal end portion;

attaching fingers provided on both sides of said central retaining finger; and a connecting piece interconnecting said retaining finger and said attaching fingers;

said at least one flange being provided with a window at a location adjacent to an outer circumferential portion thereof and first engaging members formed on sides of said window;

each of said attaching fingers of said cord retainer being provided with a second engaging member formed thereon engaging with said first engaging member;

said distal end portion of said retaining finger being brought inside said flange through said window and resiliently urged to an inner surface of said flange; and at least said attaching fingers and said connecting piece being urged to said flange from outside said flange.

19. The reel according to claim 18, wherein a recess for receiving said distal end portion of said retaining finger is formed on the inner side surface of said flange on the outer circumferential portion thereof which said distal end portion of said retaining finger is made contact with.

20. The reel according to claim 18, wherein said first engaging member is a projection projecting outward from said flange.

21. The reel according to claim 18, wherein said second engaging member is a hole.

22. The reel according to claim 18, wherein said second engaging member is a cut-out.

23. The reel according to claim 18, wherein said second engaging member is a recess.

24. The reel according to claim 18, wherein said distal end portion of said retaining finger is formed with a projection or a rib for preventing an end portion of the cord-like body from being slipped off.

25. The reel according to claim 18, wherein a reinforcing rib is formed on a part or entirety of said retaining finger, or on a part or entirety of said attaching fingers.

26. The reel according to claim 18, wherein said attaching fingers are provided with third engaging members at the distal end portions thereof, and said third engaging members are caught inside a folded-back portion along the outer circumferential portion of said flange.

27. The reel according to claim 18, wherein said cord retainer is made of a metal plate.

28. The reel according to claim 18, wherein said cord retainer is made of a piece of metal wire.

29. The reel according to claim 18, wherein the outer circumferential portion of said flange is formed to have a cord-end retaining portion at a position spaced away from said cord retainer along the outer circumference of said flange in a direction in which the cord-like body is taken up, said cord-end retaining portion being located at a position which approaches inner side of the reel from the outermost circumferential edge of said flange.

30. A reel for taking up a cord-like body, comprising:

a winding drum;

flanges provided on both ends of said winding drum, at least one of said flanges being provided with a window at a location adjacent to an outer circumferential portion thereof; and a cord retainer comprising a resilient body, said cord retainer being received within said window and including:

a central retaining finger having a distal end portion;

a pair of fixing fingers, one provided on either side of said central retaining finger and each having a distal end portion; and a connecting piece interconnecting said retaining finger and said fixing fingers;

the distal end portions of said fixing fingers being attached to an outer surface of said at least one flange, and the distal end portion of said central retaining finger lying on an inner side surface of said at least one flange on the outer circumferential portion thereof; and the cord-like body being clamped and secured between the distal end portion of said retaining finger and the inner side surface of said at least one flange at the outer circumferential portion thereof.

* * * * *

UNITED STATES PATENT AND TRADEMARK OFFICE

CERTIFICATE OF CORRECTION

PATENT NO. : 5,901,920

DATED : May 11, 1999

INVENTOR(S) : Masashi Takahashi, et al.

It is certified that error appears in the above-identified patent and that said Letters Patent is hereby corrected as shown below:

Title page, insert the following item [56].

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION | |
|---|---|---|---|---|---|---|---|---|---|---|---|---|---|---|
| | | | | | | | | | | | | | YES | NO |
| | 8 | - | 2 | 4 | 5 | 0 | 8 | 3 | 1996 | Japan | | | Abstract | |
| | 6 | - | 1 | 0 | 7 | 3 | 7 | 7 | 1994 | Japan | | | | |

Signed and Sealed this

Ninth Day of May, 2000

*Attest:*

Q. TODD DICKINSON

*Attesting Officer*

*Director of Patents and Trademarks*